US005978618A

United States Patent [19]

Yamamoto et al.

[11] Patent Number: 5,978,618

[45] Date of Patent: Nov. 2, 1999

[54] IMAGE FORMING APPARATUS WITH CONTROLLED HEAT SOURCES IN FIXING UNIT

[75] Inventors: Yoshikazu Yamamoto; Megumi Yasuda, both of Kawasaki, Japan

[73] Assignee: Fujitsu Limited, Kawasaki, Japan

[21] Appl. No.: 08/889,106

[22] Filed: Jul. 7, 1997

[30] Foreign Application Priority Data

Jan. 8, 1997 [JP] Japan ..... 9-001698

[51] Int. Cl.[6] ..... G03G 15/20

[52] U.S. Cl. ..... 399/69; 399/66; 399/328

[58] Field of Search ..... 399/66, 67, 69, 399/297, 299, 300, 306, 310, 314, 320, 328, 330, 334, 335

[56] References Cited

U.S. PATENT DOCUMENTS

| | | | |
|---|---|---|---|
| 4,585,325 | 4/1986 | Euler | 399/69 |
| 5,041,718 | 8/1991 | d'Hondt et al. | 399/330 X |
| 5,041,877 | 8/1991 | Matsumoto | 399/66 |
| 5,376,773 | 12/1994 | Masuda et al. | 219/543 |
| 5,508,797 | 4/1996 | Tonai et al. . | |
| 5,600,421 | 2/1997 | Takekoshi et al. | 399/66 |
| 5,682,576 | 10/1997 | Sakai et al. | 399/69 |
| 5,700,994 | 12/1997 | Gheer et al. | 399/328 X |
| 5,701,556 | 12/1997 | Sugimoto | 399/330 X |
| 5,740,493 | 4/1998 | Otaki et al. | 399/299 X |

FOREIGN PATENT DOCUMENTS

| | | |
|---|---|---|
| 0 376 732 A2 | 7/1990 | European Pat. Off. . |
| 0 564 420 A2 | 10/1993 | European Pat. Off. . |
| 0 797 130 A2 | 9/1997 | European Pat. Off. . |

OTHER PUBLICATIONS

Patent Abstracts of Japan vol. 014, No. 008 (P–987), Jan. 10, 1990 & JP 01 257872A (Ricoh Co Ltd), Oct. 13, 1989.

Patent Abstracts of Japan vol. 017, No. 360 (P–1569), Jul. 7, 1993 & JP 05 053447A (Tokyo Electric Co Ltd), Mar. 5, 1993.

Patent Abstracts of Japan vol. 095, No. 007, 31 Aug. 31, 1995 & JP 07 104586 A (Mita Ind Co Ltd), Apr. 21, 1995.

*Primary Examiner*—Sandra Brase

*Attorney, Agent, or Firm*—Armstrong, Westerman, Hattori, McLeland & Naughton

[57] ABSTRACT

An image forming apparatus is provided with a fixing unit having at least one fixing heat roller and a plurality of heat sources with respect to the one fixing heat roller, and a control unit for setting a target temperature with respect to each of the plurality of heat sources and independently controlling each of the heat sources.

16 Claims, 21 Drawing Sheets

IMAGE FORMING APPARATUS WITH CONTROLLED HEAT SOURCES IN FIXING UNIT

BACKGROUND OF THE INVENTION

The present invention generally relates to image forming apparatuses, and more particularly to an image forming apparatus provided with a fixing unit and/or an image forming unit suited for forming an image on a transported medium at a high speed.

Conventionally, a fixing unit using fixing rollers is used in an image forming apparatus in which a transport speed of a medium such as a recording sheet is relatively slow. When the medium transport speed is slow, an amount of heat per unit time to be supplied to the medium as the medium passes the fixing unit can be set small, and thus, a heat source of the fixing unit does not need to generate a large amount of heat.

Recently, however, there are demands to carry out a high-speed image formation in the image forming apparatus which uses the fixing unit, and the medium transport speed is increasing to meet such demands. For this reason, there are demands to increase the amount of heat per unit time that is supplied to the medium as the medium passes the fixing unit. In addition, there are also demands to suppress inconsistencies in a target temperature of the fixing unit during the medium transport to a minimum.

An image forming apparatus having a heat source with a large capacity has been proposed to meet the above described demands.

On the other hand, an image forming apparatus provided with a plurality of image forming apparatuses and capable of forming a color image has also been proposed.

However, as the thermal energy supplied by the heat source becomes large, there was a problem in that it is difficult to finely control the temperature of the fixing unit. In addition, at the time when the driving of the heat source is started, a large driving current is required to drive the heat source. For this reason, a power supply and the like of the image forming apparatus must be designed depending on the large driving current, thereby limiting the environment in which the image forming apparatus can be set up.

On the other hand, in the image forming apparatus provided with a plurality of image forming units, the same potential is applied with respect to all of the image forming units. Hence, when the medium is transported, the charge is absorbed by the medium and causes the potential to decrease, thereby introducing a problem in that the image transfer efficiency is poor.

SUMMARY OF THE INVENTION

Accordingly, it is a general object of the present invention to provide a novel and useful image forming apparatus in which the problems described above are eliminated.

A first specific object of the present invention is to provide an image forming apparatus in which a target temperature is set with respect to each of a plurality of heat sources of a fixing unit and each of the heat sources are independently controlled, so that it is possible to finely control the temperature of the fixing unit, it is possible to drive the heat sources without applying a large driving current at the time when the driving of the heat sources is started, and the environment in which the image forming apparatus is set up does not become limited.

A second specific object of the present invention is to provide an image forming apparatus which independently controls a transfer voltage with respect to each of a plurality of image forming units, so as to improve the image transfer efficiency.

Another and more specific object of the present invention is to provide an image forming apparatus comprising a fixing unit having at least one fixing heat roller and a plurality of heat sources with respect to the one fixing heat roller, and control means for setting a target temperature with respect to each of the plurality of heat sources and independently controlling each of the heat sources. According to the image forming apparatus of the present invention, it is possible to finely control the temperature of the fixing unit, and there is no need to apply a large driving current when starting the driving of the heat sources. Hence, the set up environment of the image forming apparatus will not be limited, thereby enabling the realization of the first object of the present invention described above.

Still another object of the present invention is to provide an image forming apparatus comprising a plurality of image forming units transferring images on a medium, and control means for independently controlling transfer voltages with respect to each of the plurality of image forming units. According to the image forming apparatus of the present invention, it is possible to improve the image transfer efficiency, thereby enabling the realization of the second object of the present invention described above.

Other objects and further features of the present invention will be apparent from the following detailed description when read in conjunction with the accompanying drawings.

DESCRIPTION OF THE PREFERRED EMBODIMENTS

According to one aspect of the present invention, an image forming apparatus is provided with a fixing unit having a plurality of heat sources, and a control means for setting a target temperature with respect to each of the plurality of heat sources and independently controlling each of the heat sources. Because the target temperature is set with respect to each of the plurality of heat sources of the fixing unit and each of the heat sources are controlled independently, it is possible to finely control the temperature of the fixing unit. In addition, the heat sources can be driven without applying a large driving current at the time when driving of the heat sources is started, and for this reason, the environment in which the image forming apparatus may be set up does not become limited.

Furthermore, according to another aspect of the present invention, an image forming apparatus is provided with a plurality of image forming units which transfer an image on a medium, and a control means for independently controlling a transfer voltage with respect to each of the plurality of image forming units. Because the transfer voltage is independently controlled with respect to each of the plurality of image forming units, it is possible to improve the image transfer efficiency.

Figure 1:
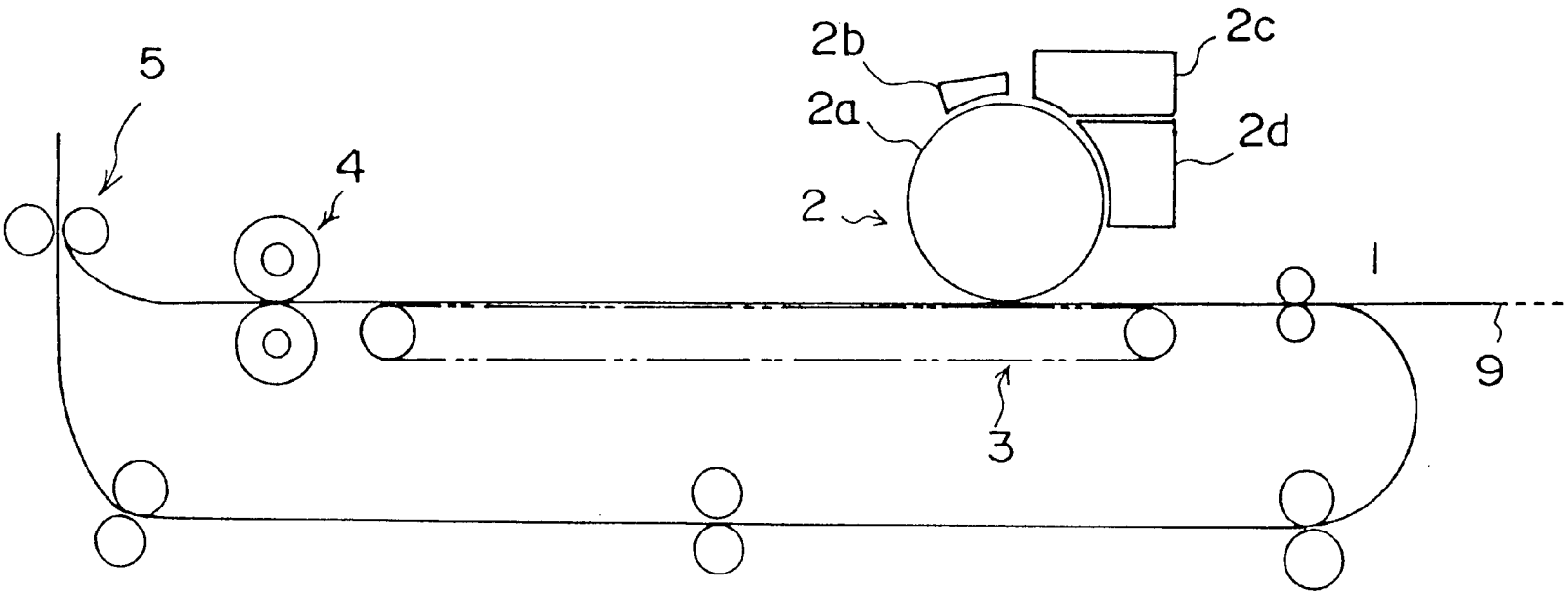
FIG. 1 is a diagram showing the construction of a part of a first embodiment of an image forming apparatus according to the present invention.

FIG. 1 is a diagram showing a part of a first embodiment of the image forming apparatus according to the present invention. In this embodiment, the present invention is applied to a printer which is provided with a single image forming unit and prints an image with respect to plain paper, for the sake of convenience.

In FIG. 1, when a recording sheet 9 is supplied from a paper supply unit 1, a toner image developed on a photoconductive drum 2*a* of an image forming unit 2 is transferred onto the recording sheet 9, and this recording sheet is transported to a fixing unit 4 by a transport belt 3. The toner image is fixed on the recording sheet by the fixing unit 4, and the recording sheet 9 is thereafter ejected from the image forming apparatus via an eject unit 5. The image forming unit 2 itself has a known construction comprising the photoconductive drum 2*a,* a precharger 2*b,* an exposure unit 2*c* and a developing unit 2*d.*

Figure 2:
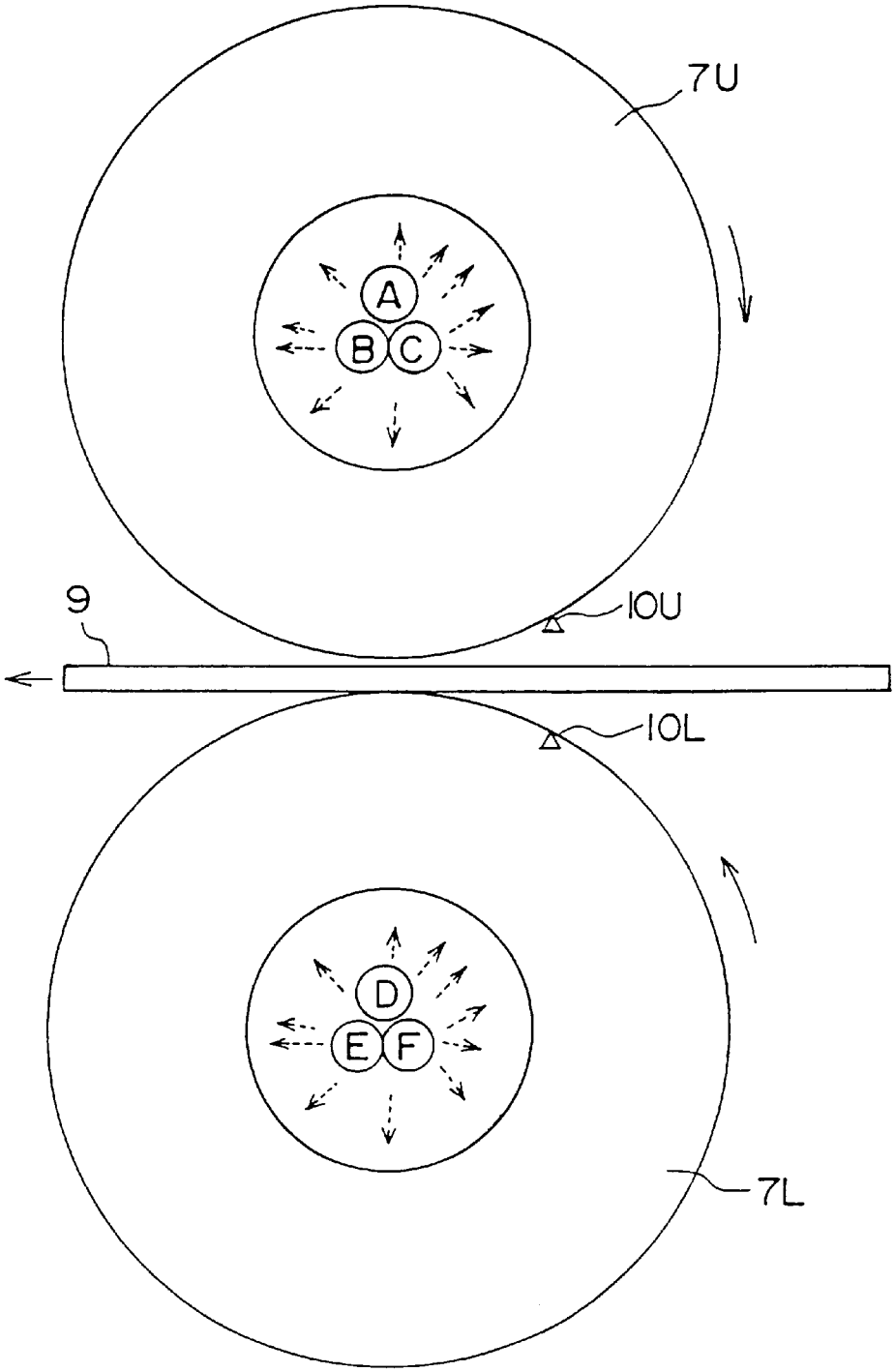
FIG. 2 is a cross sectional view showing fixing heat rollers of a fixing unit.

As shown in FIG. 2, the fixing unit 4 includes a pair of fixing heat rollers 7U and 7L, and each of the fixing heat rollers 7U and 7L has a plurality of heating elements. In this embodiment, each of the fixing heat rollers 7U and 7L has three halogen lamps which form the heating elements. More particularly, the fixing heat roller 7U has three halogen lamps A, B and C, and the temperature of the fixing heat roller 7U is detected by a temperature sensor 10U. Similarly, the fixing heat roller 7L has three halogen lamps D, E and F, and the temperature of the fixing heat roller 7L is detected by a temperature sensor 10L.

In this embodiment, the temperature of each of the halogen lamps A through F and the drive timing of each of the halogen lamps A through F are controlled independently. For example, by changing the duty value of the driving (current applying) time per unit time with respect to each of the halogen lamps A, B and C depending on the temperature of the fixing heat roller 7U detected by the temperature sensor 10U, it is possible to change the amount of heat supplied to the recording sheet 9 per unit time. Similarly, by changing the duty value of the driving (current applying) time per unit time with respect to each of the halogen lamps D, E and F depending on the temperature of the fixing heat roller 7L detected by the temperature sensor 10L, it is possible to change the amount of heat supplied to the recording sheet 9 per unit time. A maximum energy supplying condition with respect to each of the halogen lamps A through F is a state where the duty value is 100%.

Figure 3:
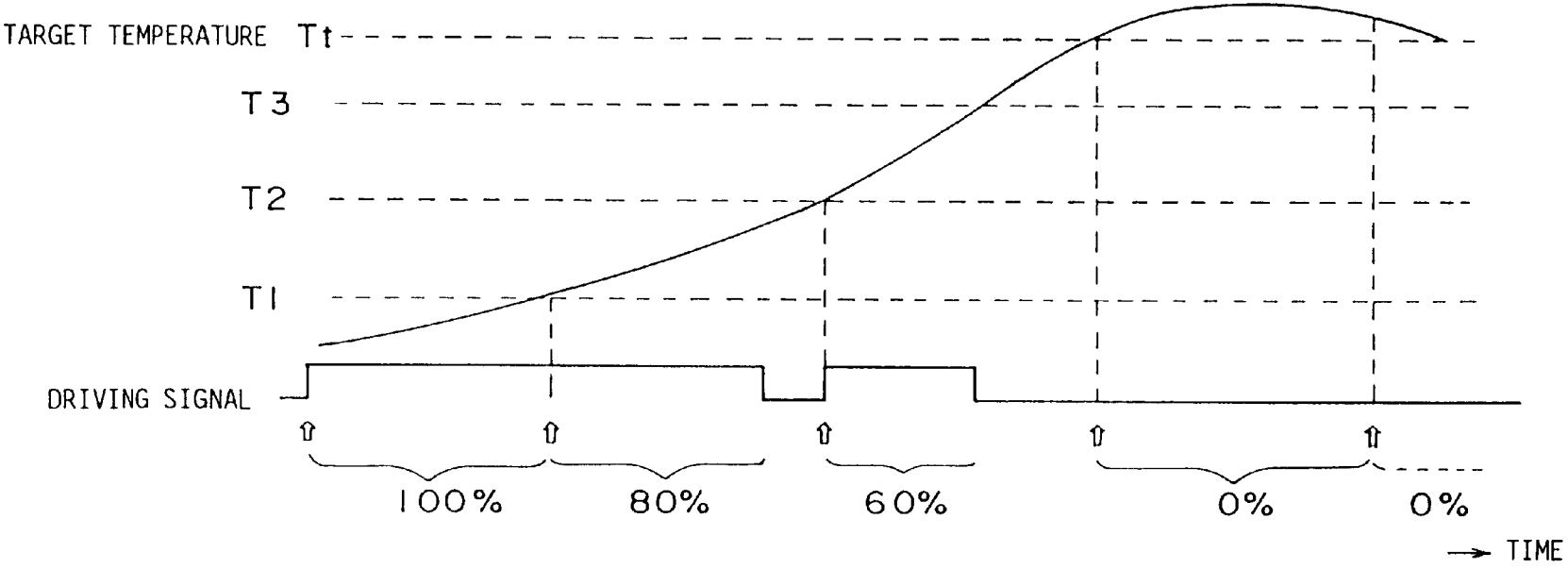
FIG. 3 is a diagram showing the relationship between temperature and driving signal with respect to a halogen lamp of a fixing heat roller.

FIG. 3 is a diagram showing the relationship between the temperature and a driving signal with respect to the halogen lamp A of the fixing heat roller 7U. In FIG. 3, Tt denotes a target temperature, and T1, T2 and T3 respectively denote temperatures satisfying a relationship T1<T2<T3. FIG. 3 shows the duty value of the driving time with respect to the temperature up to the time when the target temperature Tt is reached for a case where the halogen lamp A is driven from a temperature less than or equal to the target temperature Tt. In this embodiment, the temperature of the halogen lamp A is rapidly increased when the temperature is considerably lower than the target temperature Tt, and the duty value of the driving time is decreased as the temperature becomes closer to the target temperature Tt, so as to suppress an overshoot when the target temperature Tt is reached.

The target temperature and the duty value of the driving time are also set with respect to the other halogen lamps B and C of the fixing heat roller 7U, and a control similar to that carried out with respect to the halogen lamp A is carried out with respect to the other halogen lamps B and C. The target temperatures and the driving times which are set with respect to the halogen lamps B and C may be the same as or, be different from the target temperature and the driving time which are set with respect to the halogen lamp A. As a result, it is possible to finely control the temperature of the fixing heat roller 7U. The control with respect to each of the halogen lamps D through F of the fixing heating roller 7L may be carried out similarly to the above described control with respect to the halogen lamp A.

Figure 4:
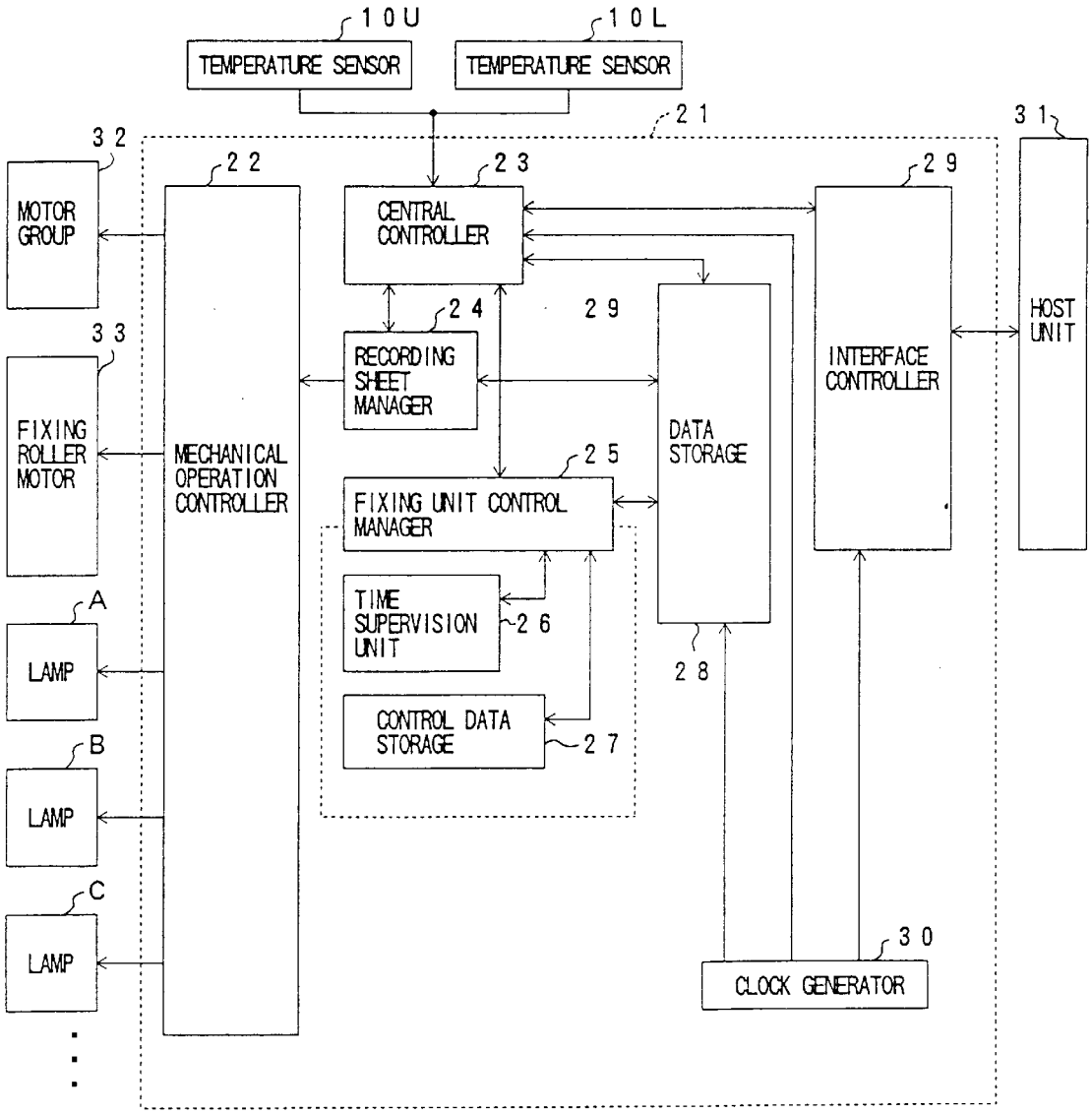
FIG. 4 is a system block diagram showing the construction of a part of the first embodiment of the image forming apparatus.

FIG. 4 is a system block diagram for explaining the operation of the first embodiment in more detail. FIG. 4 shows only those parts of the image forming apparatus directly related to the operation of this embodiment.

The image forming apparatus shown in FIG. 4 generally includes a printer part 21, the temperature sensors 10U and 10L, a motor group 32, a fixing roller motor 33, and the halogen lamps A through F. The printer part 21 includes a mechanical operation controller 22, a central controller 23, a recording sheet manager 24, a fixing unit control manager 25, a time supervision unit 26, a control data storage 27, a data storage 28, an interface controller 29, and a clock generator 30. A host unit 31 may be a part of the image forming apparatus or, be a host to the image forming apparatus.

The central controller 23 includes a CPU or the like which controls the entire operation of the printer part 21 based on an instruction which is obtained from the host unit 31 via the interface controller 29. Data required for the operation of the central controller 23 and intermediate data are stored in the data storage 28. The recording sheet manager 24 controls the motor group 32 and the fixing roller motor 33 via the mechanical operation controller 22, based on an instruction from the central controller 23, size and position of the recording sheet 9 and the like. The mechanical operation controller 22 forms an interface between various mechanical parts connected to the printer part 21 and control parts within the printer part 21. The motor group 32 includes a motor for driving the paper supply unit 1, a motor for driving the transport belt 3, a motor for driving a roller of the paper eject unit 5 and the like.

The fixing unit manager 25, the time supervision unit 26 and the control data storage 27 are provided to make the fixing unit 4 carry out the operation of this embodiment. The fixing unit manager 25 controls the halogen lamps A through F of the fixing heat rollers 7U and 7L within the fixing unit 4 via the mechanical operation controller 22, based on time information from the time supervision unit 26 and control data from the control data storage 27. The time information from the time supervision unit 26 includes drive timings of each of the halogen lamps A through F and the like. In addition, the control data from the control data storage 27 includes the duty values of the driving times and the like. The clock generator 30 supplies clock signals to the mechanical operation controller 22, the central controller 23, the data storage 28, the interface controller 29 and the like within the printer part 21.

For example, a CPU or the like having a known construction may be used to form the fixing unit control manager 25, and in this case, the time supervision unit 26 may be realized by an internal timer or the like of the CPU. In addition, a known storage means may be used to form the control data storage 27, such as a ROM which stores programs to be executed by the CPU and a RAM which stores data and intermediate data used by the programs of the CPU.

The central controller 23 and the recording sheet manager 24 may be realized by use of a single processor such as a CPU. Further, it is possible to realize the central controller 23, the fixing unit control manager 25 and the time supervision unit 26 by a single processor such as a CPU. Moreover, the central controller 23, the recording sheet manager 24, the fixing unit control manager 25 and the time supervision unit 26 may be realized by a single processor such as a CPU.

Figure 5:
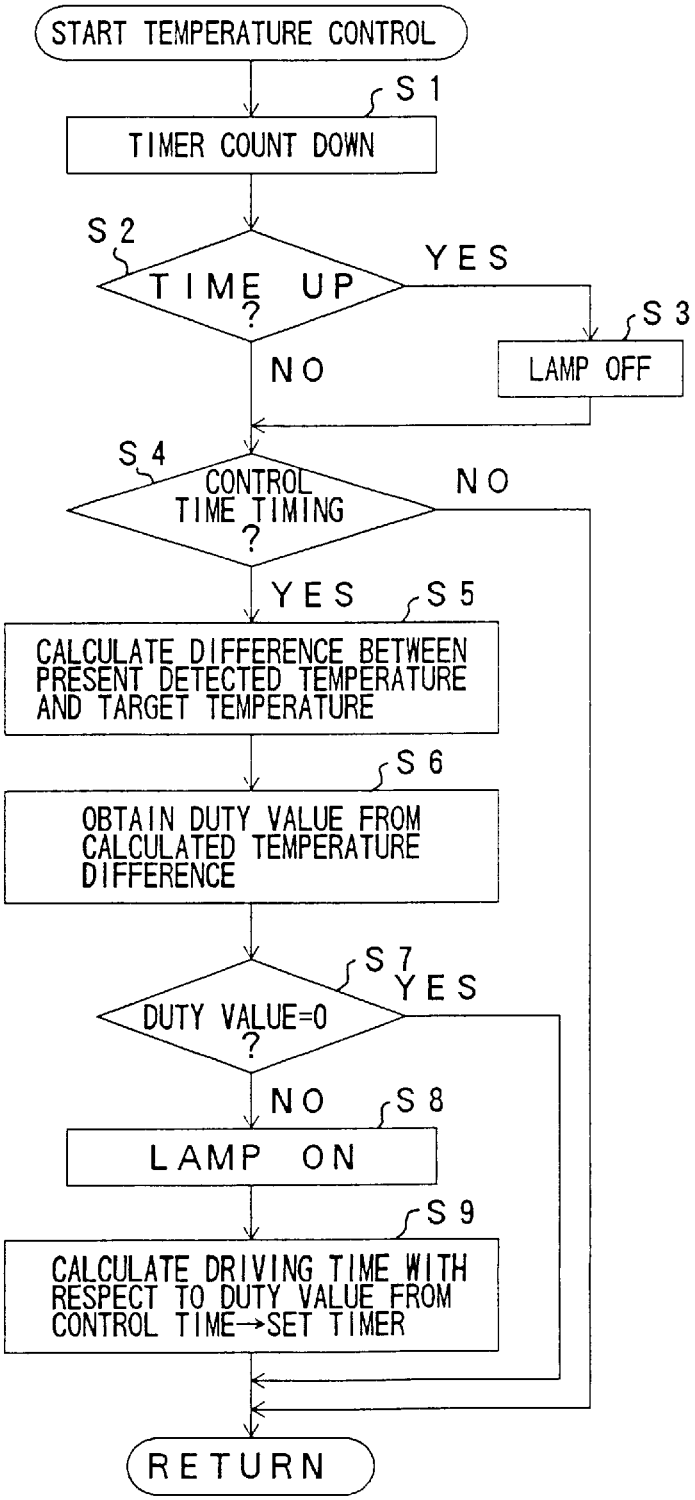
FIG. 5 is a flow chart for explaining a first embodiment of the operation of a CPU.

FIG. 5 is a flow chart for explaining a first embodiment of the operation of a CPU when at least the fixing unit control manager 25 and the time supervision unit 26 are formed by the CPU. For the sake of convenience, it is assumed in this embodiment that a temperature control process shown in FIG. 5 is carried out for every 5 ms.

In FIG. 5, a step S1 turns ON the halogen lamp A of the fixing heat roller 7U within the fixing unit 4, for example, and starts a count down operation of the timer within the CPU. A step S2 decides whether or not the counted value of the timer reached a set value, and a step S3 turns OFF the halogen lamp A if the decision result in the step S2 is YES. If the decision result in the step S2 is NO or after the step S3, a step S4 decides whether or not a timing of the control time is reached. The process ends if the decision result in the step S4 is NO.

On the other hand, if the decision result in the step S4 is YES, a step S5 calculates a temperature difference between the present detected temperature of the fixing heat roller 7U obtained from the temperature sensor 10U and the target temperature of the halogen lamp A. A step S6 obtains the duty value of the driving time from the calculated temperature difference, based on the control data prestored in the control data storage 27. The duty value of the driving time may be obtained by carrying out a calculation or by use of a table. The following Table 1 shows an example of this table.

TABLE 1

| Temperature Difference ° C. | ≧1 | 0 | −1 | −2 | −3 | −4 | −5 | −6 | −7 . . . |
|---|---|---|---|---|---|---|---|---|---|
| Duty Value % | 0 | 0 | 5 | 10 | 15 | 20 | 25 | 30 | 35 . . . |

Accordingly, if the detected temperature of the fixing heat roller 7U is 175° C. and the target temperature of the halogen lamp A is 180° C., for example, the temperature difference that is obtained in the step S5 is −5° C., and the step S6 obtains the duty value which is 25% by referring to the Table 1.

A step S7 decides whether or not the duty value is 0, and the process ends if the decision result in the step S7 is YES. On the other hand, if the decision result in the step S7 is NO, a step S8 turns ON the halogen lamp A. In addition, a step S9 calculates from the control time the driving time with respect to the duty value, and the process ends by setting the above described timer. For example, if the control time is 500 ms and the duty value is 25%, the driving time of the halogen lamp A becomes 125 ms.

Processes similar to the temperature control process shown in FIG. 5 are carried out in parallel with respect to the remaining halogen lamps B and C of the fixing heat roller 7U, and the tables used during such processes may be the same as or different from the table with respect to the halogen lamp A. In addition, processes similar to the above described temperature control process with respect to the halogen lamps A through C of the fixing heat roller 7U are carried out in parallel with respect to each of the halogen lamps D through F of the fixing heat roller 7L.

Figure 6B:
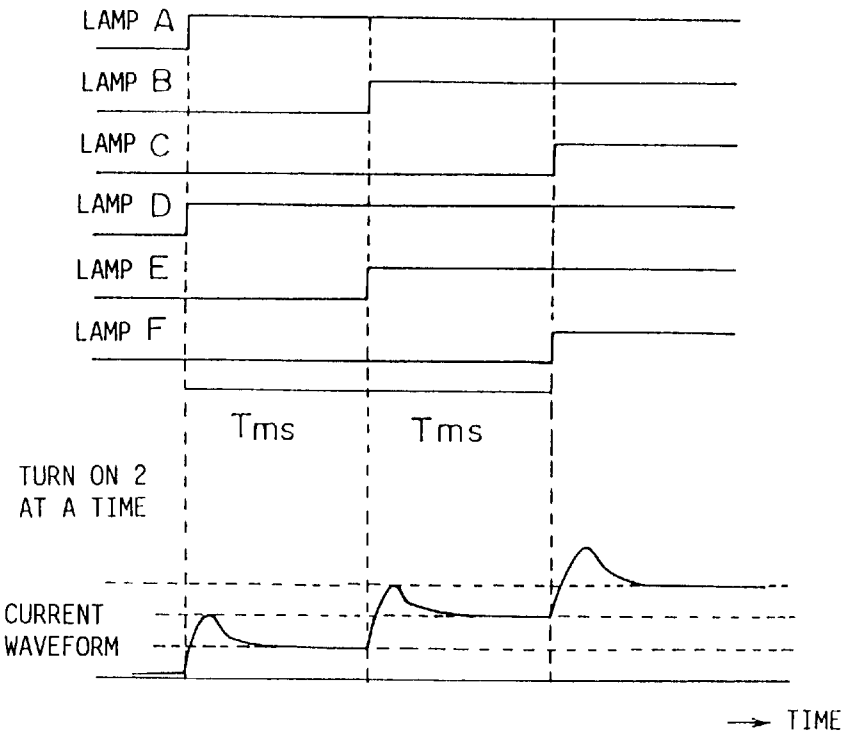
FIGS. 6A and 6B respectively are time charts for explaining a second embodiment of the operation of the CPU.
Figure 6A:
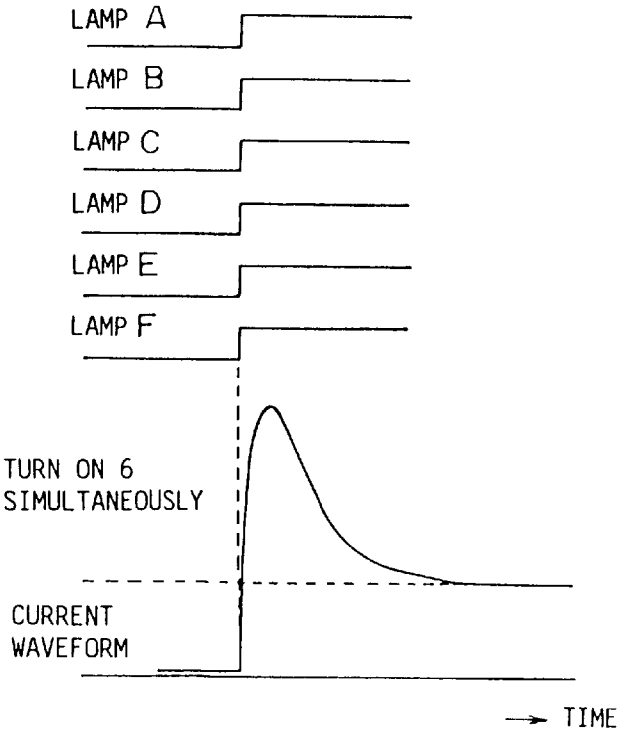
Figure 7:
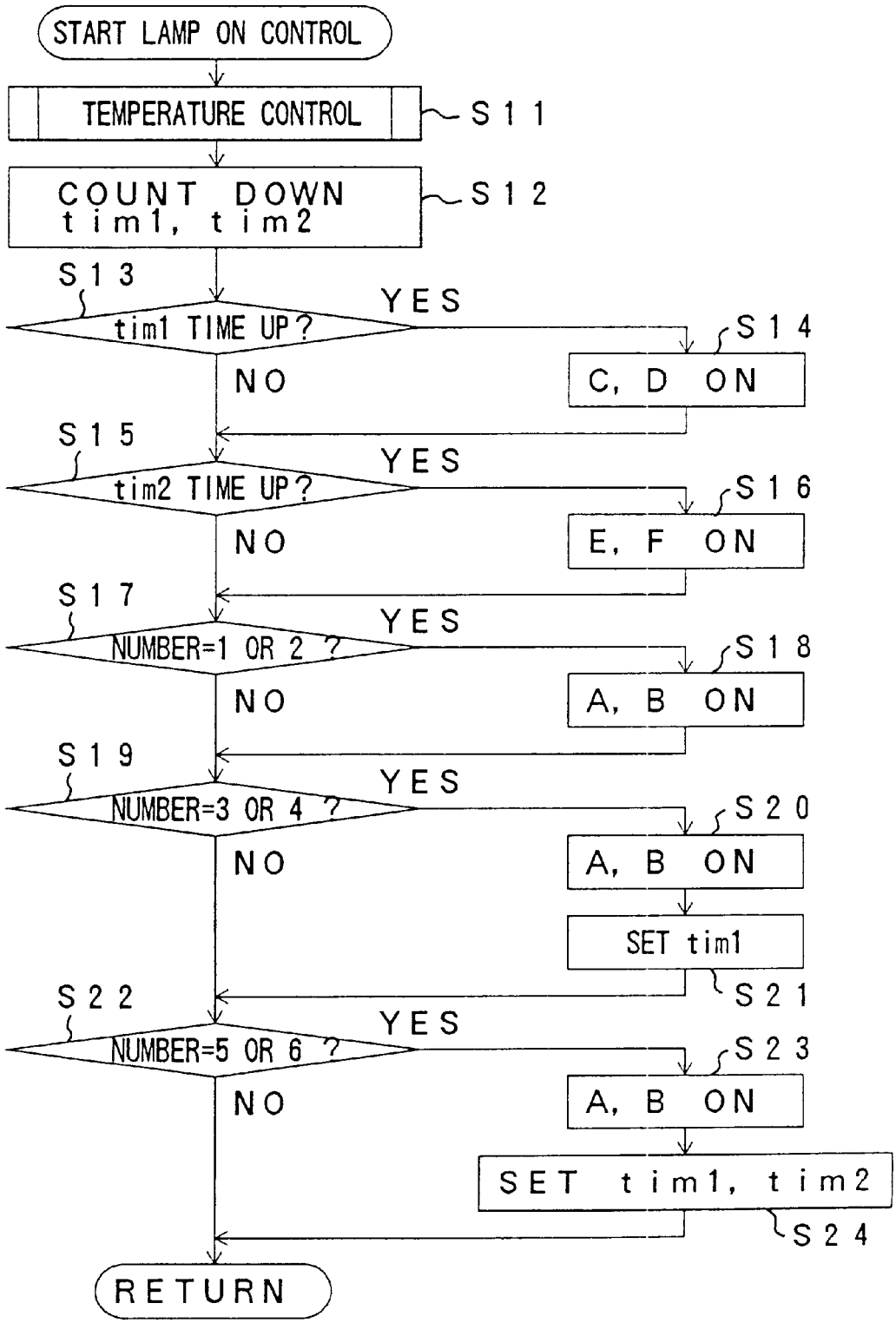
FIG. 7 is a flow chart for explaining the second embodiment of the operation of the CPU.

Next, a description will be given of a second embodiment of the operation of the CPU, by referring to FIGS. 6A, 6B and 7. FIGS. 6A and 6B respectively are time charts for explaining the second embodiment of the operation of the CPU, and FIG. 7 is a flow chart for explaining the second embodiment of the operation of the CPU. In the first embodiment of the operation of the CPU described above, a large driving current must initially be applied to the fixing unit 4 if all of the halogen lamps A through F of the fixing unit 4 are to be driven simultaneously at the same timing. Hence, in this second embodiment of the operation of the CPU, the driving current which is initially required is suppressed to a low value by shifting the drive timings of the halogen lamps A through F.

In other words, this embodiment of the operation of the CPU restricts a maximum number of halogen lamps which are driven simultaneously to two, for example, so as to carry out a control such that the remaining halogen lamps are driven after a predetermined time T. FIG. 6A shows the driving current waveforms for a case where all of the six halogen lamps A through F are driven simultaneously, in correspondence with the ON/OFF states of each of the halogen lamps A through F. FIG. 6B shows the driving current waveforms for a case where the six halogen lamps A through F are driven in groups of two, in correspondence with the ON/OFF states of each of the halogen lamps A through F. Of course, the order in which the groups of halogen lamps are driven need not be fixed.

It is assumed in this embodiment of the operation of the CPU that the maximum number of halogen lamps which are simultaneously turned ON is two as described above, and that a lamp ON control process shown in FIG. 7 is carried out for every 5 ms. In FIG. 7, a step S11 carries out a temperature control process similar to that shown in FIG. 5, for example. A step S12 starts count down operations of ON-timers tim1 and tim2 within the CPU. A step S13 decides whether or not the counted value of the timer tim1 reached a first set value, and if the decision result is YES, a step S14 turns ON the halogen lamps that are OFF out of the halogen lamps which are requested to turn ON. In this embodiment of the operation of the CPU, it is assumed for the sake of convenience that all of the halogen lamps A through F are requested to be turn ON. Accordingly, the halogen lamps C and D, for example, are turned ON in the step S14. After the step S14 or if the decision result in the step S13 is NO, a step S15 decides whether or not the counted value of the timer tim2 reached a second set value. If the decision result in the step S15 is YES, a step S16 turns ON the halogen lamps that are OFF out of the halogen lamps which are requested to turn ON. In this case, the halogen lamps E and F are turned ON in the step S16.

After the step S16 or if the decision result in the step S15 is NO, a step S17 decides whether or not the number of halogen lamps which are requested to turn ON is one or two. If the decision result in the step S17 is YES, a step S18 turns ON the halogen lamps which are requested to turn ON. In this case, the halogen lamps A and B are turned ON in the step S18. After the step S18 or if the decision result in the step S17 is NO, a step S19 decides whether or not the number of halogen lamps which are requested to turn ON is three or four. If the decision result in the step S19 is YES, a step S20 turns ON the halogen lamps which are requested to turn ON. In this case, the halogen lamps A and B are turned ON in the step S20. In addition, a step S21 sets the first set value of the timer tim1 to 100 ms, for example. After the step S21 or if the decision result in the step S19 is NO, a step S22 decides whether or not the number of halogen lamps which are requested to turn ON is five or six. If the decision result in the step S22 is YES, a step S23 turns ON the halogen lamps which are requested to turn ON. In this case, the halogen lamps A and B are turned ON in the step S23. Further, a step S24 sets the first set value of the timer tim1 to 100 ms, for example, and sets the second set value of the timer tim2 to 200 ms, for example. After the step S24 or if the decision result in the step S22 is NO, the process ends.

Next, a description will be given of a third embodiment of the operation of the CPU. If the timings with which the driving of the halogen lamps A through F start are shifted by the predetermined time T as in the case of the second embodiment of the operation of the CPU, the actual amount of heat generated by each of the fixing heat rollers 7U and 7L becomes smaller than an anticipated amount by a thermal energy corresponding to the predetermined time. Hence, in this third embodiment of the operation of the CPU, the time when the driving of the halogen lamp stops is delayed by the predetermined time T with respect to the halogen lamp which starts to be driven at the delayed timing, in order to compensate for the insufficient amount of heat generated by the fixing heat rollers 7U and 7L.

Figure 8:
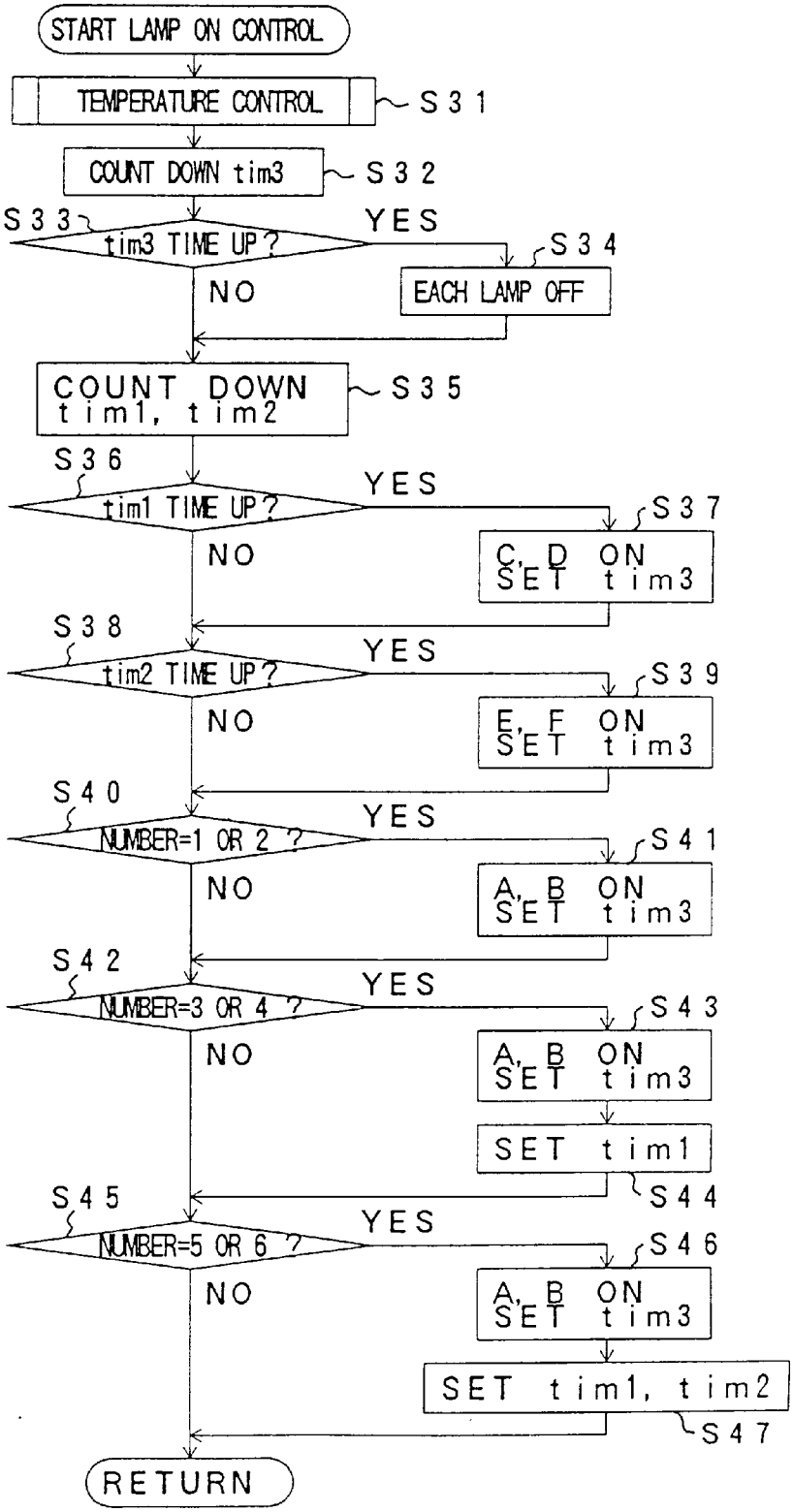
FIG. 8 is a flow chart for explaining a third embodiment of the operation of the CPU.

FIG. 8 is a flow chart for explaining the third embodiment of the operation of the CPU. In this embodiment of the operation of the CPU, it is also assumed for the sake of convenience that the maximum number of halogen lamps which are simultaneously turned ON is two as described above, and that a lamp ON control process shown in FIG. 8 is carried out for every 5 ms.

In FIG. 8, a step S31 carries out a temperature control process similar to that shown in FIG. 5, for example. A step S32 starts count down operations of six OFF-timers tim3 within the CPU. A step S33 decides whether or not the counted value of each timer tim3 reached a set value, and if the decision result is YES, a step S34 turns ON each of the halogen lamps A through F. After the step S34 or if the decision result in the step S33 is NO, a step S35 starts count down operations of ON-timers tim1 and tim2 within the CPU. A step S36 decides whether or not the counted value of the timer tim1 reached a first set value. If the decision result in the step S36 is YES, a step S37 turns ON the halogen lamps that are OFF out of the halogen lamps which are requested to turn ON, and also sets the timers tim3 of these halogen lamps which are turned ON. In this embodiment of the operation of the CPU, it is assumed for the sake of convenience that all of the halogen lamps A through F are requested to turn ON. Accordingly, the halogen lamps C and D are turned ON, for example, and the timers tim3 with respect to these halogen lamps C and D are set in the step S37. After the step S37 or if the decision result in the step S36 is NO, a step S38 decides whether or not the counted value of the timer tim2 reached a second set value. If the decision result in the step S38 is YES, a step S39 turns ON the halogen lamps that are OFF out of the halogen lamps which are requested to turn ON, and also sets the timers tim3 of these halogen lamps which are turned ON. In this case, the halogen lamps E and F are turned ON and the timers tim3 with respect to these halogen lamps E and F are set in the step S39.

After the step S39 or if the decision result in the step S38 is NO, a step S40 decides whether or not the number of halogen lamps which are requested to turn ON is one or two. If the decision result in the step S40 is YES, a step S41 turns ON the halogen lamps which are requested to turn ON, and also sets the timers tim3 with respect to these halogen lamps which are turned ON. In this case, the halogen lamps A and B are turned ON and the timers tim3 with respect to these halogen lamps A and B are set in the step S41. After the step S41 or if the decision result in the step S40 is NO, a step S42 decides whether or not the number of halogen lamps which are requested to turn ON is three or four. If the decision result in the step S42 is YES, a step S43 turns ON the halogen lamps which are requested to turn ON, and also sets the timers tim3 with respect to these halogen lamps which are turned ON. In this case, the halogen lamps A and B are turned ON and the timers tim3 with respect to these halogen lamps A and B are set in the step S43. In addition, a step S44 sets the first set value of the timer tim1 to 100 ms, for example. After the step S44 or if the decision result in the step S42 is NO, a step S45 decides whether or not the number of halogen lamps which are requested to turn ON is five or six. If the decision result in the step S45 is YES, a step S46 turns ON the halogen lamps which are requested to turn ON, and also sets the timers tim3 with respect to these halogen lamps which are turned ON. In this case, the halogen lamps A and B are turned ON and the timers tim3 with respect to these halogen lamps A and B are set in the step S46. Further, a step S47 sets the first set value of the timer tim1 to 100 ms, for example, and sets the second set value of the timer tim2 to 200 ms, for example. After the step S47 or if the decision result in the step S45 is NO, the process ends.

Figure 9:
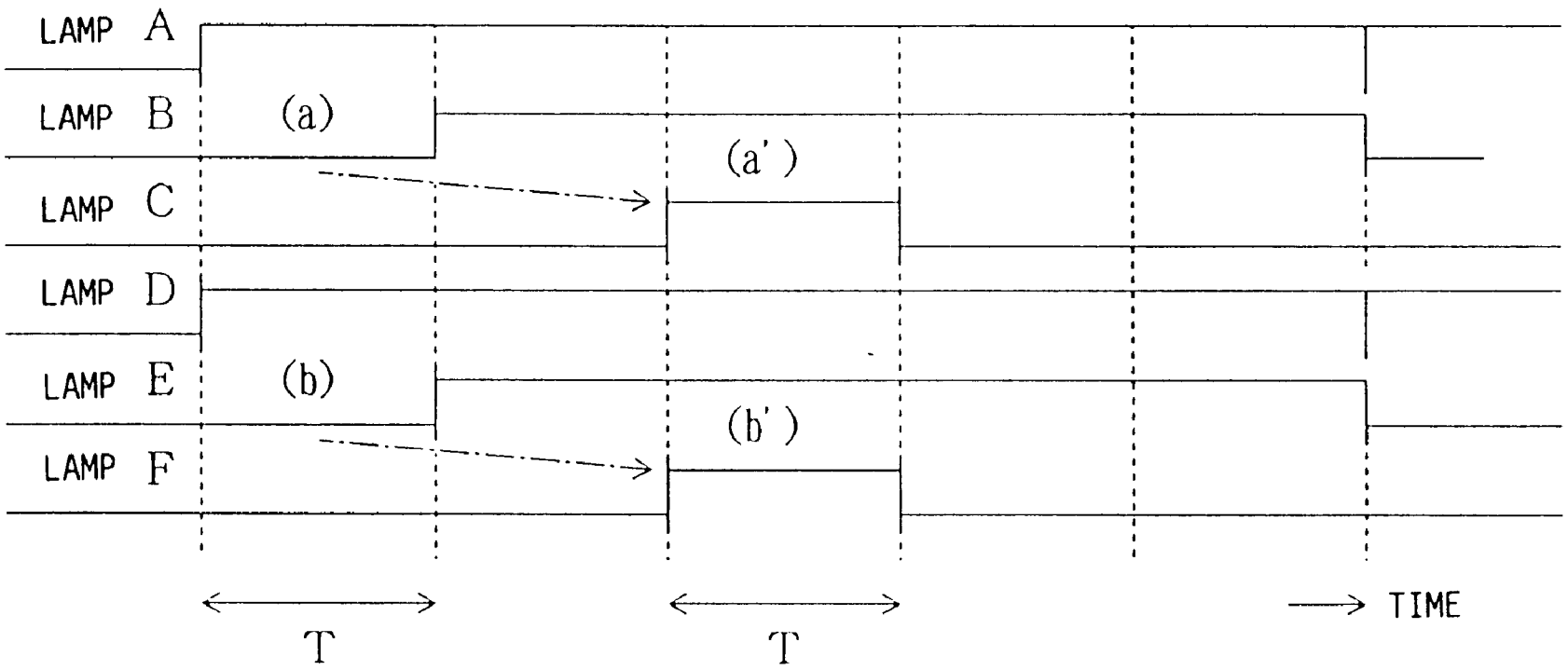
FIG. 9 is a time chart for explaining a fourth embodiment of the operation of the CPU.
Figure 10:
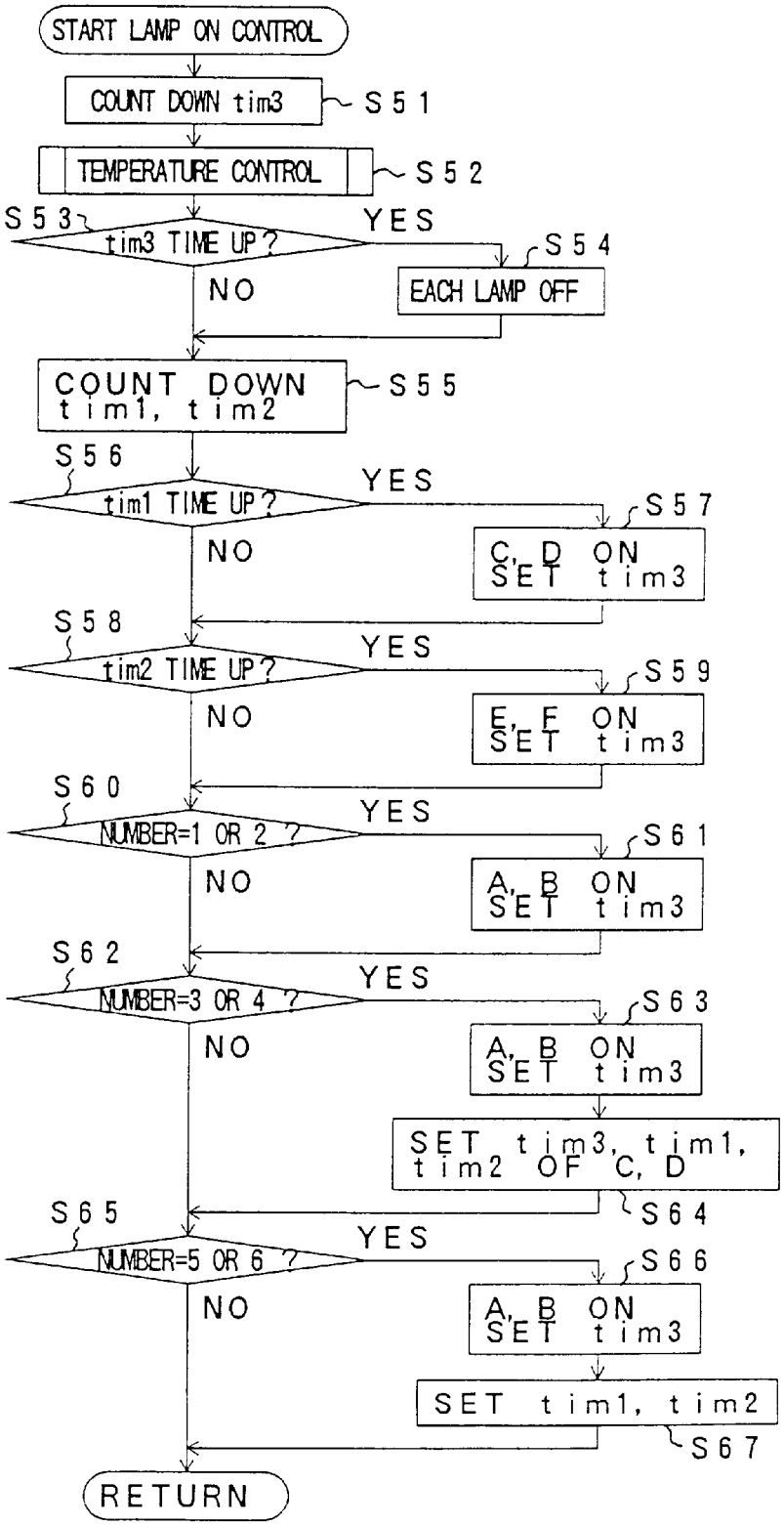
FIG. 10 is a flow chart for explaining the fourth embodiment of the operation of the CPU.

Next, a description will be given of a fourth embodiment of the operation of the CPU, by referring to FIGS. 9 and 10. FIG. 9 is a time chart for explaining the fourth embodiment of the operation of the CPU, and FIG. 10 is a flow chart for explaining the fourth embodiment of the operation of the CPU. If the timings with which the driving of the halogen lamps A through F start are shifted by the predetermined time T as in the case of the second embodiment of the operation of the CPU, the actual amount of heat generated by each of the fixing heat rollers 7U and 7L becomes smaller than an anticipated amount by a thermal energy corresponding to the predetermined time. Hence, in order to compensate for the insufficient amount of heat generated by the fixing heat rollers 7U and 7L due to the halogen lamp which starts to be driven at the delayed timing, this fourth embodiment of the operation of the CPU drives the halogen lamp which is originally not driven.

In the case shown in FIG. 9, the drive start time of the halogen lamp B is shifted by the predetermined time T with respect to the drive start time of the halogen lamp A, as indicated by (a). Accordingly, the insufficient thermal energy which should originally be supplied by the halogen lamp B and corresponds to the predetermined time T, is compensated for by driving for the predetermined time T the halogen lamp C which is originally not driven, as indicated by (a') in FIG. 9. Similarly, in the case shown in FIG. 9, the drive start time of the halogen lamp E is shifted by the predetermined time T with respect to the drive start time of the halogen lamp D, as indicated by (b). Accordingly, the insufficient thermal energy which should originally be supplied by the halogen lamp E and corresponds to the predetermined time T, is compensated for by driving for the predetermined time T the halogen lamp F which is originally not driven, as indicated by (b') in FIG. 9.

In this embodiment of the operation of the CPU, it is also assumed for the sake of convenience that the maximum number of halogen lamps which are simultaneously turned ON is two as described above, and that a lamp ON control process shown in FIG. 10 is carried out for every 5 ms. In FIG. 10, a step S51 starts count down operations of six OFF-timers tim3 within the CPU. A step S52 carries out a temperature control process similar to that shown in FIG. 5, for example. A step S53 decides whether or not the counted value of each timer tim3 reached a set value, and if the decision result is YES, a step S54 turns ON each of the halogen lamps A through F. After the step S54 or if the decision result in the step S53 is NO, a step S55 starts count down operations of ON-timers tim1 and tim2 within the CPU. A step S56 decides whether or not the counted value of the timer tim1 reached a first set value. If the decision result in the step S56 is YES, a step S57 turns ON the halogen lamps that are OFF out of the halogen lamps which are requested to turn ON, and also sets the timers tim3 of these halogen lamps which are turned ON. In this embodiment of the operation of the CPU, it is assumed for the sake of convenience that all of the halogen lamps A through F are requested to turn ON. Accordingly, the halogen lamps C and D are turned ON, for example, and the timers tim3 with respect to these halogen lamps C and D are set in the step S57. After the step S57 or if the decision result in the step S56 is NO, a step S58 decides whether or not the counted value of the timer tim2 reached a second set value. If the decision result in the step S58 is YES, a step S59 turns ON the halogen lamps that are OFF out of the halogen lamps which are requested to turn ON, and also sets the timers tim3 of these halogen lamps which are turned ON. In this case, the halogen lamps E and F are turned ON and the timers tim3 with respect to these halogen lamps E and F are set in the step S59.

After the step S59 or if the decision result in the step S58 is NO, a step S60 decides whether or not the number of halogen lamps which are requested to turn ON is one or two. If the decision result in the step S60 is YES, a step S61 turns ON the halogen lamps which are requested to turn ON, and also sets the timers tim3 with respect to these halogen lamps which are turned ON. In this case, the halogen lamps A and B are turned ON and the timers tim3 with respect to these halogen lamps A and B are set in the step S61. After the step S61 or if the decision result in the step S60 is NO, a step S62 decides whether or not the number of halogen lamps which are requested to turn ON is three or four. If the decision result in the step S62 is YES, a step S63 turns ON the halogen lamps which are requested to turn ON, and also sets the timers tim3 with respect to these halogen lamps which are turned ON. In this case, the halogen lamps A and B are turned ON and the timers tim3 with respect to these halogen lamps A and B are set in the step S63. In addition, a step S64 sets the first set value of the timer tim1 to 100 ms, for example, sets the second set value of the timer tim2 to 100 ms, for example, and sets the set value of the timers tim3 to 100 ms, for example. After the step S64 or if the decision result in the step S62 is NO, a step S65 decides whether or not the number of halogen lamps which are requested to turn ON is five or six. If the decision result in the step S65 is YES, a step S66 turns ON the halogen lamps which are requested to turn ON, and also sets the timers tim3 with respect to these halogen lamps which are turned ON. In this case, the halogen lamps A and B are turned ON and the timers tim3 with respect to these halogen lamps A and B are set in the step S66. Further, a step S67 sets the first set value of the timer tim1 to 100 ms, for example, and sets the second set value of the timer tim2 to 200 ms, for example. After the step S67 or if the decision result in the step S65 is NO, the process ends.

Figure 11:
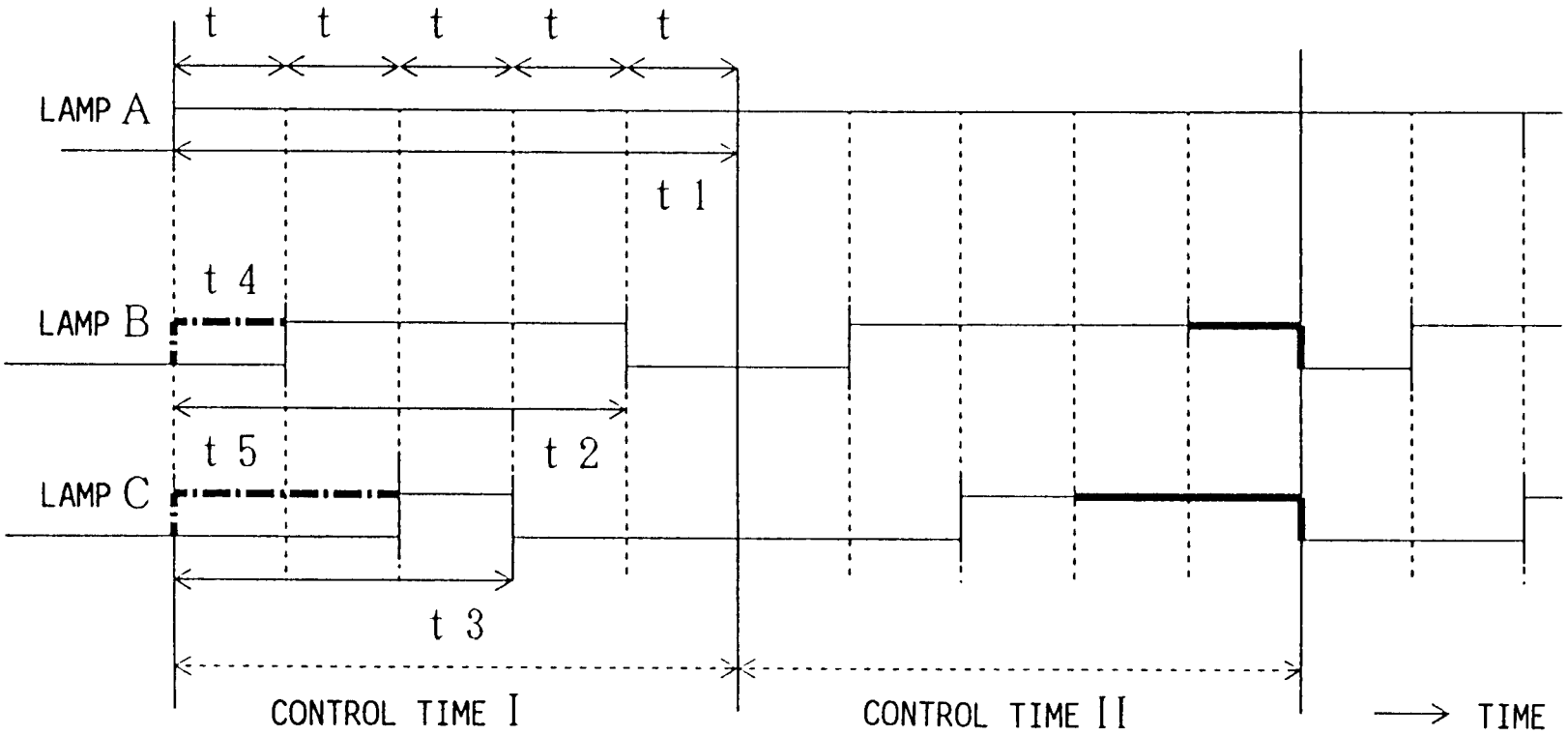
FIG. 11 is a time chart for explaining a fifth embodiment of the operation of the CPU.
Figure 12:
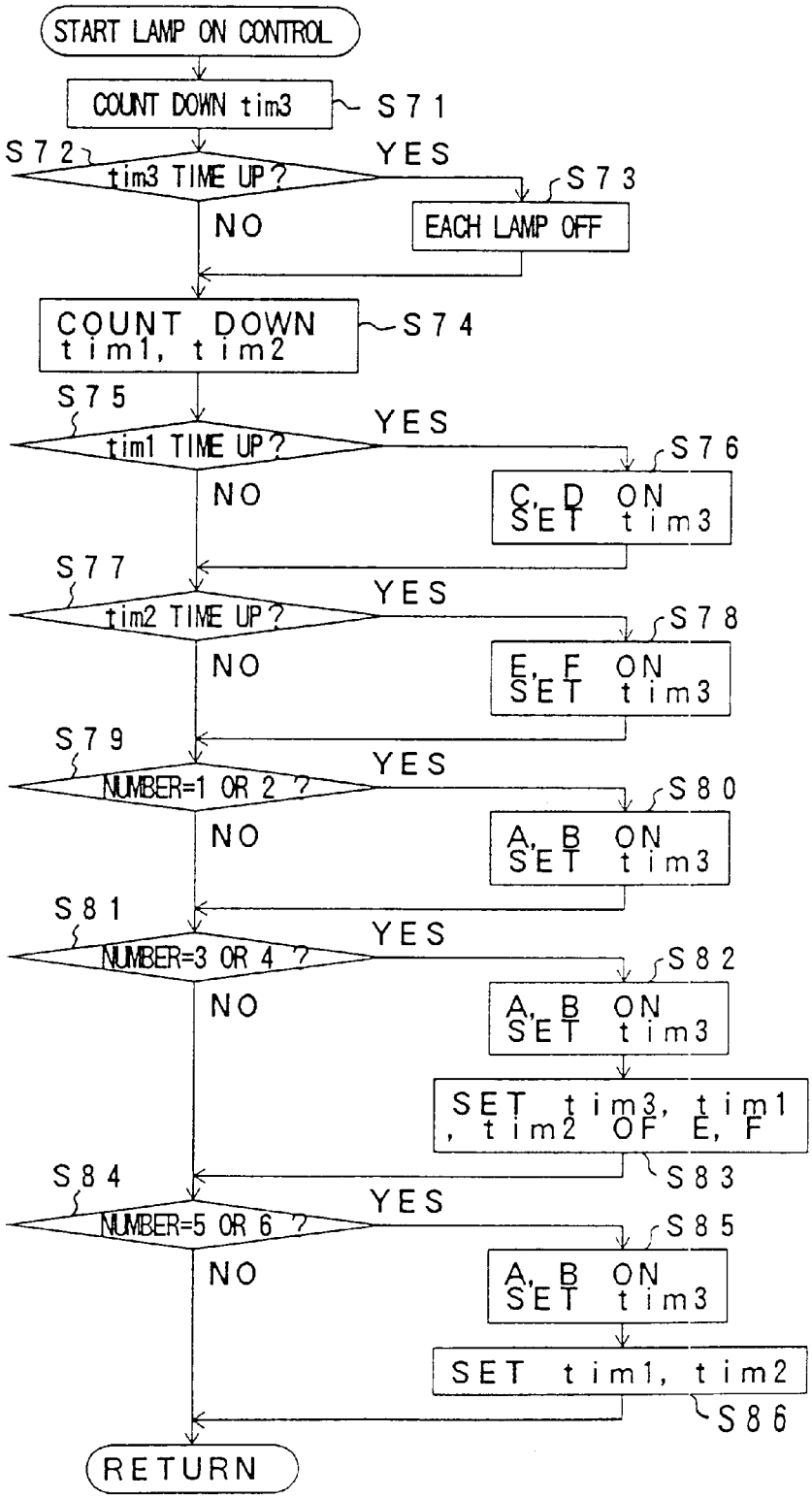
FIG. 12 is a flow chart for explaining the fifth embodiment of the operation of the CPU.

Next, a description will be given of a fifth embodiment of the operation of the CPU, by referring to FIGS. 11 and 12. FIG. 11 is a time chart for explaining the fifth embodiment of the operation of the CPU, and FIG. 12 is a flow chart for explaining the fifth embodiment of the operation of the CPU. If the timings with which the driving of the halogen lamps A through F start are shifted by the predetermined time T as in the case of the second embodiment of the operation of the CPU, the actual amount of heat generated by each of the fixing heat rollers 7U and 7L becomes smaller than an anticipated amount by a thermal energy corresponding to the predetermined time. Hence, in order to compensate for the insufficient amount of heat generated by the fixing heat rollers 7U and 7L due to the halogen lamp which starts to be driven at the delayed timing, this fifth embodiment of the operation of the CPU calculates the insufficient amount of heat and corrects the amount of heat per unit time or per unit area.

In the case shown in FIG. 11, it is assumed that there is a driving request such that the driving time of the halogen lamp A is t1 seconds, the driving time of the halogen lamp B is t2 seconds, and the driving time of the halogen lamp C is t3 seconds. In this case, it is assumed that a time corresponding to the insufficient amount of heat supplied by the halogen lamp B is t4 seconds, and a time corresponding to the insufficient amount of heat supplied by the halogen lamp C is t5. Since the amount of heat generated per unit time is constant for each of the halogen lamps A through C, FIG. 11 shows the operation timing with respect to a case where the requested amount of heat to be generated is 12t if the thermal energy is replaced and described in terms of the time t. During a control interval I in which no correction is made, the actual amount of heat that is generated is only 9t. However, during a control interval II in which the correction is made, a correction amounting to the insufficient amount of 3t with respect to 12t which is the requested amount of heat to be generated, the actual amount of heat that is generated becomes 12t. Accordingly, it is possible to correctly supply the requested amount of heat to be generated, that is, 12t, by making the correction during the control interval II.

In FIG. 11, a bold one-dot chain line indicates the drive timing which is originally requested and corresponds to the insufficient amount of heat, a solid line indicates the actual drive timing before the correction, and a bold solid line indicates the drive timing after the correction to compensate for the insufficient amount of heat.

In this embodiment of the operation of the CPU, it is also assumed for the sake of convenience that the maximum number of halogen lamps which are simultaneously turned ON is two as described above, and that a lamp ON control process shown in FIG. 12 is carried out for every 5 ms. In FIG. 12, a step S71 starts count down operations of six OFF-timers tim3 within the CPU. A step S72 decides whether or not the counted value of each timer tim3 reached a set value, and if the decision result is YES, a step S73 turns ON each of the halogen lamps A through F. After the step S73 or if the decision result in the step S72 is NO, a step S74 starts count down operations of ON-timers tim1 and tim2 within the CPU. A step S75 decides whether or not the counted value of the timer tim1 reached a first set value. If the decision result in the step S75 is YES, a step S76 turns ON the halogen lamps that are OFF out of the halogen lamps which are requested to turn ON, and also sets the timers tim3 of these halogen lamps which are turned ON. In this embodiment of the operation of the CPU, it is assumed for the sake of convenience that all of the halogen lamps A through F are requested to turn ON. Accordingly, the halogen lamps C and D are turned ON, for example, and the timers tim3 with respect to these halogen lamps C and D are set in the step S76. After the step S76 or if the decision result in the step S75 is NO, a step S77 decides whether or not the counted value of the timer tim2 reached a second set value. If the decision result in the step S77 is YES, a step S78 turns ON the halogen lamps that are OFF out of the halogen lamps which are requested to turn ON, and also sets the timers tim3 of these halogen lamps which are turned ON to values added with a unit time corresponding to the thermal energy that is not yet supplied. In this case, the halogen lamps E and F are turned ON and the timers tim3 with respect to these halogen lamps E and F are set to the set values added with 200 ms in the step S78.

After the step S78 or if the decision result in the step S77 is NO, a step S79 decides whether or not the number of halogen lamps which are requested to turn ON is one or two. If the decision result in the step S79 is YES, a step S80 turns ON the halogen lamps which are requested to turn ON, and also sets the timers tim3 with respect to these halogen lamps which are turned ON. In this case, the halogen lamps A and B are turned ON and the timers tim3 with respect to these halogen lamps A and B are set in the step S80. After the step S80 or if the decision result in the step S79 is NO, a step S81 decides whether or not the number of halogen lamps which are requested to turn ON is three or four. If the decision result in the step S81 is YES, a step S82 turns ON the halogen lamps which are requested to turn ON, and also sets the timers tim3 with respect to these halogen lamps which are turned ON. In this case, the halogen lamps A and B are turned ON and the timers tim3 with respect to these halogen lamps A and B are set in the step S82. In addition, a step S83 sets the first set value of the timer tim1 to 100 ms, for example, sets the second set value of the timer tim2, and sets the set value of the timers tim3 with respect to the halogen lamps E and F. After the step S83 or if the decision result in the step S81 is NO, a step S84 decides whether or not the number of halogen lamps which are requested to turn ON is five or six. If the decision result in the step S84 is YES, a step S85 turns ON the halogen lamps which are requested to turn ON, and also sets the timers tim3 with respect to these halogen lamps which are turned ON. In this case, the halogen lamps A and B are turned ON and the timers tim3 with respect to these halogen lamps A and B are set in the step S85. Further, a step S86 sets the first set value of the timer tim1 to 100 ms, for example, and sets the second set value of the timer tim2 to 200 ms, for example. After the step S86 or if the decision result in the step S84 is NO, the process ends.

Figure 13A:
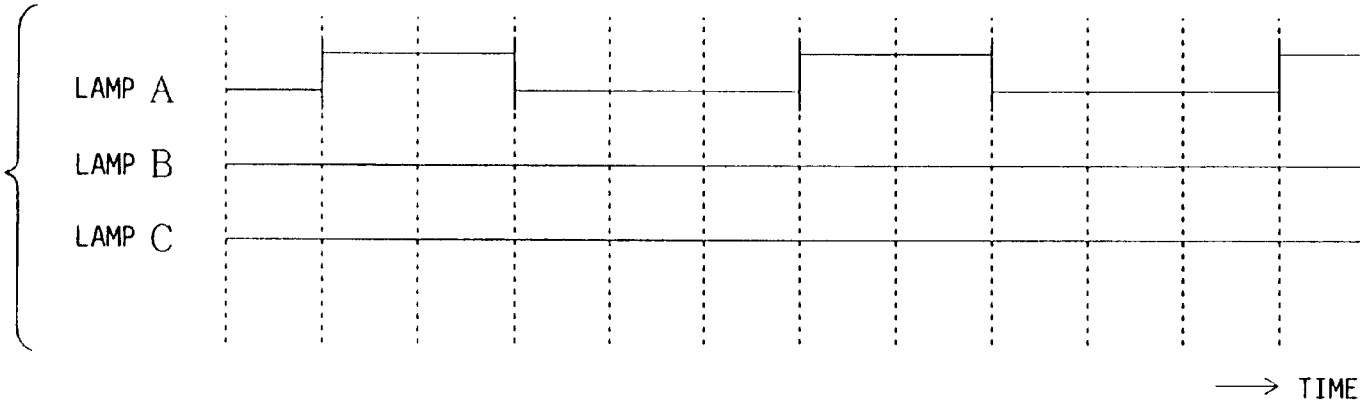
FIGS. 13A and 13B respectively are time charts for explaining a sixth embodiment of the operation of the CPU.
Figure 13B:
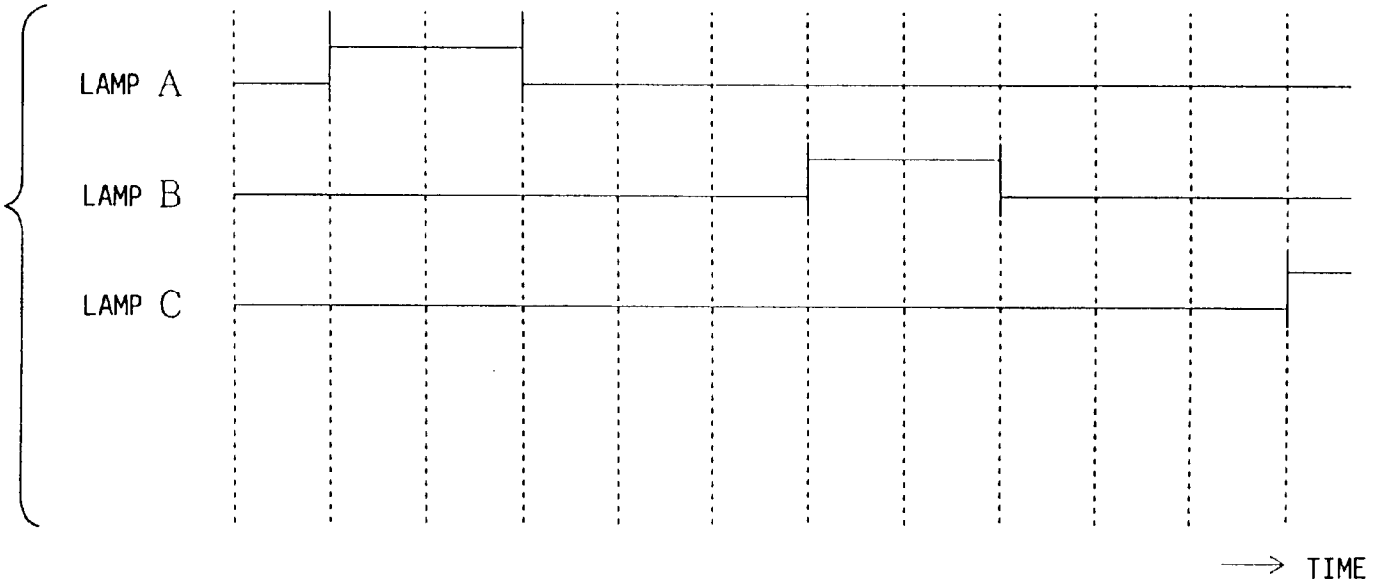

Next, a description will be given of a sixth embodiment of the operation of the CPU, by referring to FIGS. 13A through 16. FIGS. 13A and 13B respectively are time charts for explaining the sixth embodiment of the operation of the CPU, and FIGS. 14 through 16 respectively are flow charts for explaining the sixth embodiment of the operation of the CPU. For example, if it is assumed that target temperatures TempA, TempB and TempC of the halogen lamps A, B and C within one fixing heat roller 7U satisfy a relationship TempA>TempB>TempC, only the halogen lamp A is driven when the temperature of the fixing unit 4 stabilizes. For this reason, the serviceable life of the halogen lamp C becomes the shortest. Hence, this embodiment changes the definition of the halogen lamps A through C at predetermined timings, so that the serviceable lives of the halogen lamps A through C are averaged.

FIG. 13A shows the drive timing which is originally requested, and FIG. 13B shows the drive timing for a case where the definition of the halogen lamps is changed. By using the drive timing shown in FIG. 13B, it is possible to average the serviceable lives of the halogen lamps A through C.

Figure 14:
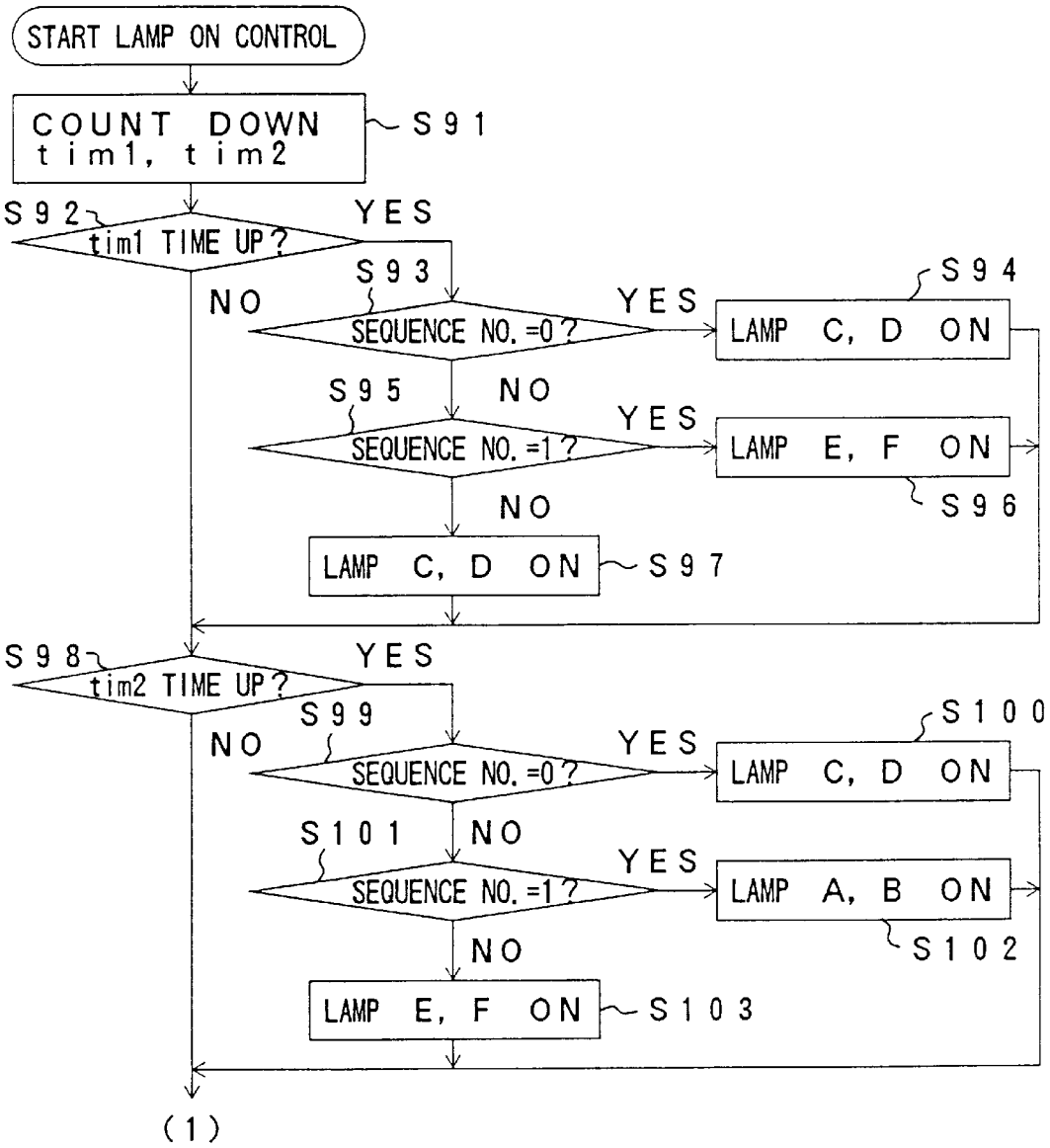
FIG. 14 is a flow chart for explaining the sixth embodiment of the operation of the CPU.
Figure 15:
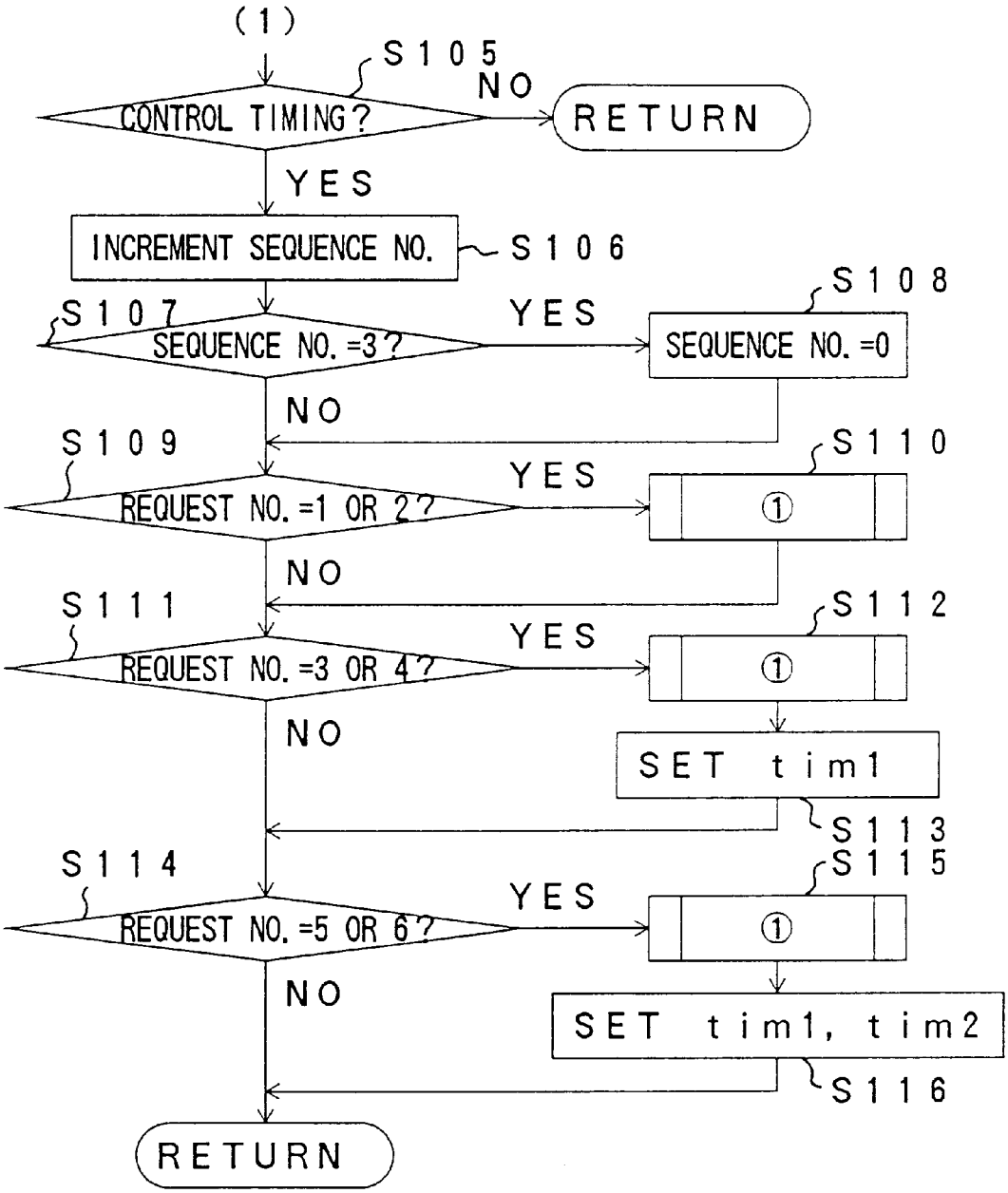
FIG. 15 is a flow chart for explaining the sixth embodiment of the operation of the CPU.

In this embodiment of the operation of the CPU, it is also assumed for the sake of convenience that the maximum number of halogen lamps which are simultaneously turned ON is two as described above, and that a lamp ON control process shown in FIGS. 14 and 15 is carried out for every 5 ms. In FIG. 14, a step S91 starts count down operations of ON-timers tim1 and tim2 within the CPU. A step S92 decides whether or not the counted value of the timer tim1 reached a first set value, and if the decision result is YES, a step S93 decides whether or not a driving sequence number is "0". If the decision result in the step S93 is YES, a step S94 turns ON the halogen lamps A and B, and the process advances to a step S98 which will be described later. On the other hand, if the decision result in the step S93 is NO, a step S95 decides whether or not the driving sequence number is "1". If the decision result in the step S95 is YES, a step S96 turns ON the halogen lamps E and F, and the process advances to the step S98 which will be described later. In addition, if the decision result in the step S95 is NO, a step S97 turns ON the halogen lamps C and D, and the process advances to the step S98 which will be described later.

After the step S94, S96 or S97 or, if the decision result in the step S92 is NO, the step S98 decides whether or not the counted value of the timer tim2 reached a second set value, and if the decision result is YES, a step S99 decides whether or not the driving sequence number is "0". If the decision result in the step S99 is YES, a step S100 turns ON the halogen lamps C and D, and the process advances to a step S105 which will be described later. On the other hand, if the decision result in the step S99 is NO, a step S101 decides whether or not the driving sequence number is "1". If the decision result in the step S101 is YES, a step S102 turns ON the halogen lamps A and B, and the process advances to the step S105 which will be described later. In addition, if the decision result in the step S101 is NO, a step S103 turns ON the halogen lamps E and F, and the process advances to the step S105 which will be described later.

In FIG. 15, the step S105 decides whether or not a timing of the control time is reached, and the process ends if the decision result in the step S105 is NO. On the other hand, if the decision result in the step S105 is YES, a step S106 increments the driving sequence number by "1". A step S107 decides whether or not the driving sequence number is "3", and if the decision result is YES, a step S108 sets the driving sequence number to "0". After the step S108 or if the decision result in the step S107 is NO, a step S109 decides whether or not the number of halogen lamps which are requested to turn ON is one or two. A step S110 is carried out if the decision result in the step S109 is YES.

Figure 16:
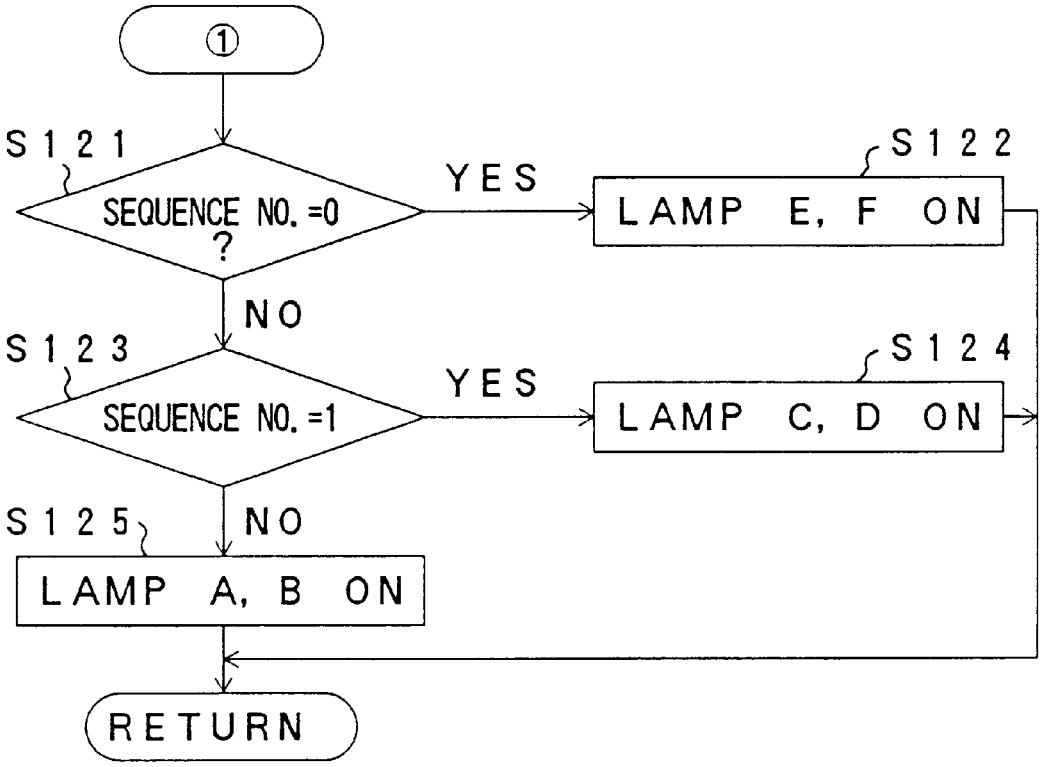
FIG. 16 is a flow chart for explaining the sixth embodiment of the operation of the CPU.

The step S110 carries out a process shown in FIG. 16. More particularly, a step S121 decides whether or not the driving sequence number is "0". If the decision result in the step S121 is YES, a step S122 turns ON the halogen lamps E and F, and the process returns to the process (in this case, to a step S111) shown in FIG. 15. On the other hand, if the decision result in the step S121 is NO, a step S123 decides whether or not the driving sequence number is "1". If the decision result in the step S123 is YES, a step S124 turns ON the halogen lamps C and D, and the process returns to the process shown in FIG. 15. In addition, if the decision result in the step S123 is NO, a step S125 turns ON the halogen lamps A and B, and the process returns to the process shown in FIG. 15.

After the step S110 shown in FIG. 15 or if the decision result in the step S109 is NO, the step S111 decides whether or not the number of halogen lamps which are requested to turn ON is three or four. A step S112 is carried out if the decision result in the step S111 is YES. The process carried out by the step S112 is the same as the process shown in FIG. 16. In addition, a step S113 sets the first set value of the timer tim1 to 100 ms, for example.

After the step S113 or if the decision result in the step S111 is NO, a step S114 decides whether or not the number of halogen lamps which are requested to turn ON is five or six. A step S115 is carried out if the decision result in the step S114 is YES. The process carried out by the step S115 is the same as the process shown in FIG. 16. In addition, a step S116 sets the first set value of the timer tim1 to 100 ms, for example, and sets the second set value of the timer tim2 to 200 ms, for example. After the step S116 or if the decision result in the step S114 is NO, the process ends.

According to the first embodiment of the image forming apparatus described above employing the first through sixth embodiments of the operation of the CPU, the target temperature is set with respect to each of the plurality of heat sources of the fixing unit, and each of the heat sources is controlled independently, thereby making it possible to finely control the temperature of the fixing unit. In addition, since the heat sources can be driven without applying a large driving current at the time when the driving of the heat sources is started, the set up environment of the image forming apparatus will not be limited.

In the image forming apparatus provided with a plurality of image forming units, the same potential is applied with respect to all of the image forming units. Hence, when the medium is transported, the charge is absorbed by the medium and causes the potential to decrease, thereby deteriorating the image transfer efficiency. In addition, depending on the set up environment of the image forming apparatus and the operation state of the image forming apparatus, there are cases where the image transfer efficiency deteriorates. Hence, a description will now be given of an embodiment which can improve the image transfer efficiency by independently controlling the transfer voltage with respect to each of the plurality of image forming units.

Figure 17:
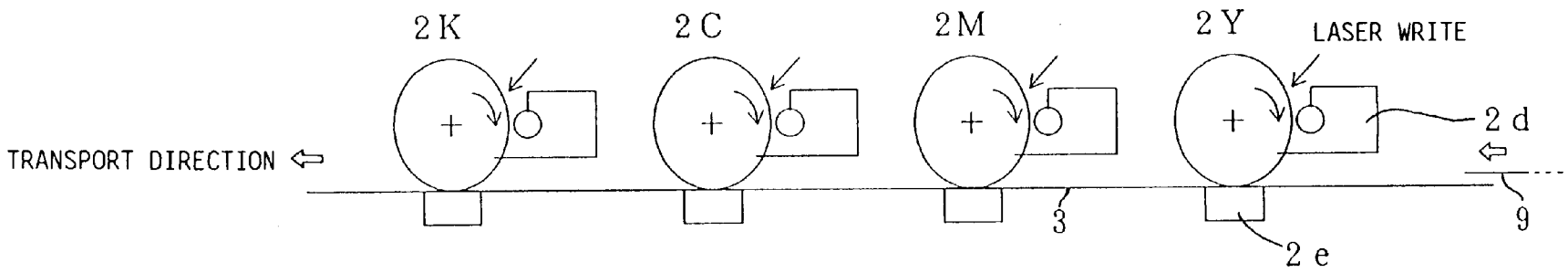
FIG. 17 is a diagram showing a part of a second embodiment of the image forming apparatus according to the present invention.

FIG. 17 is a diagram for explaining a second embodiment of the image forming apparatus according to the present invention, and shows a part of the second embodiment of the image forming apparatus. In this embodiment, it is assumed for the sake of convenience that the present invention is applied to a printer which has four image forming units and prints the image with respect to plain paper.

As shown in FIG. 17, this embodiment successively forms yellow, magenta, cyan and black images on the recording sheet 9 which is transported in a transport direction indicated by an arrow by the transport belt 3, by four image forming units 2Y, 2M, 2C and 2K. The image forming units 2Y, 2M, 2C and 2K themselves may have a known construction. For example, each of the image forming units 2Y, 2M, 2C and 2K includes the photoconductive drum 2*a*, the precharger 2*b*, the exposure unit 2*c* and the developing unit 2*d* shown in FIG. 1, a transfer charger 2*e* and the like. The illustration of a transport mechanism for the recording sheet 9, the fixing unit and the like is omitted in FIG. 17.

If transfer voltages of the image forming units 2Y, 2M, 2C and 2K are respectively denoted by V1, V2, V3 and V4, the charge is absorbed by the recording sheet 9 as the recording sheet 9 is transported. Hence, this embodiment sets the transfer voltages V1, V2, V3 and V4 of the image forming units 2Y, 2M, 2C and 2K to satisfy a relationship $V1<V2<V3<V4$, and independently controls the transfer voltages V1, V2, V3 and V4 of the image forming units 2Y, 2M, 2C and 2K.

In addition, there are cases where not all of the image forming units 2Y, 2M, 2C and 2K are used. For example, when the yellow image is not formed, the transfer voltages V2, V3 and V4 of the image forming units 2M, 2C and 2K are set to satisfy a relationship $V2<V3<V4$, and the transfer voltages V2, V3 and V4 of the image forming units 2M, 2C and 2K are controlled independently. Similarly, when the magenta and cyan images are not formed, the transfer voltages V1 and V4 of the image forming units 2Y and 2K are set to satisfy a relationship $V1<V4$, and the transfer voltages V1 and V4 of the image forming units 2Y and 2K are controlled independently.

Furthermore, the transfer voltages V1, V2, V3 and V4 of the image forming units 2Y, 2M, 2C and 2K do not need to be fixed values. In other words, the transfer voltages V1, V2, V3 and V4 may be variably set to optimum values depending on the set up environment of the image forming apparatus, such as the temperature and humidity, and depending on the operation stage of the image forming apparatus, such as a developing agent agitating time. When offset values of the transfer voltages V1, V2, V3 and V4 of the image forming units 2Y, 2M, 2C and 2K for the case where the environment, operation state and the like of the image forming apparatus are taken into consideration are respectively denoted by Vy, Vm, Vc and Vk, corrected transfer voltages of the image forming units 2Y, 2M, 2C and 2K can respectively be described by V1+Vy, V2+Vm, V3+Vc and V4+Vk. In this case, the transfer voltages V1, V2, V3 and V4 are controlled independently or, the corrected transfer voltages V1+Vy, V2+Vm, V3+Vc and V4+Vk which take the offset values Vy, Vm, Vc and Vk into consideration are controlled independently, so that the relative relationships of the corrected transfer voltages V1+Vy, V2+Vm, V3+Vc and V4+Vk of the image forming units 2Y, 2M, 2C and 2K do not change and the relationships V2−V1>Vy, V3−V2>Vm and T4−T3>Vc are satisfied.

Figure 18:
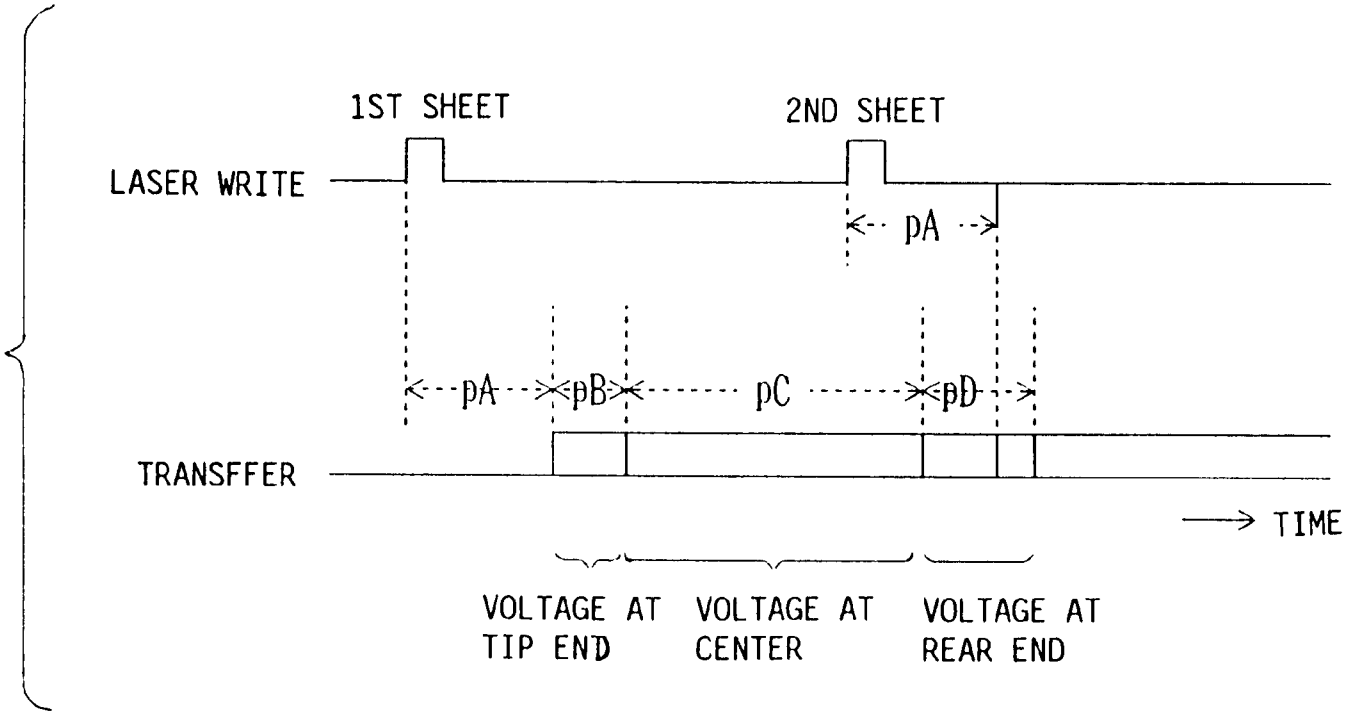
FIG. 18 is a diagram showing timings with which an image is written on a photoconductive drum by a laser and the image is transferred from the photoconductive drum to a recording sheet.

Timings with which the transfer voltages are applied with respect to each of the image forming units 2Y, 2M, 2C and 2K may be controlled as shown in FIG. 18, for example. FIG. 18 is a diagram showing a timing with which the image is written on the photoconductive drum 2*a* of the image forming unit 2Y, for example, by a laser, and a timing with which the image is transferred from this photoconductive drum 2*a* to the recording sheet 9. The laser write timings and the image transfer timings are similarly controlled independently with respect to the other image forming units 2M, 2C and 2K.

In FIG. 18, pA denotes a time from a time when laser write starts to a time when the transfer voltage with respect to a tip end of the recording sheet 9 is applied, pB denotes a time from the time when the transfer voltage with respect to the tip end of the recording sheet 9 is applied to a time when the transfer voltage with respect to a center of the recording sheet 9 is applied, pC denotes a time from a time when the transfer voltage with respect to the center of the recording sheet 9 is applied to a time when the transfer voltage with respect to a rear end of the recording sheet 9 is applied, and pD denotes a time from a time when the transfer voltage with respect to the rear end of the recording sheet 9 is applied to a time when the applying of the transfer voltage stops. Hence, it is possible to easily control the change in the transfer voltage among the recording sheets 9. In other words, it is possible to determine the timing with which the image transfer starts with respect to the recording sheet 9 by variably setting the value of the time pA, and it is possible to determine the timing with which the image transfer stops with respect to the recording sheet 9 by variably setting the value of the time pD. In addition, it is possible to cope with the recording sheets 9 having different lengths along the transport direction, by variably setting the value of the time pC. The values of the above described times pA through pD may be set independently with respect to each of the image forming units 2Y, 2M, 2C and 2K, but when a standardized control is taken into account, it is possible to simplify the control by setting the values of the times pA through pD to the same values with respect to each of the image forming units 2Y, 2M, 2C and 2K.

Figure 19:
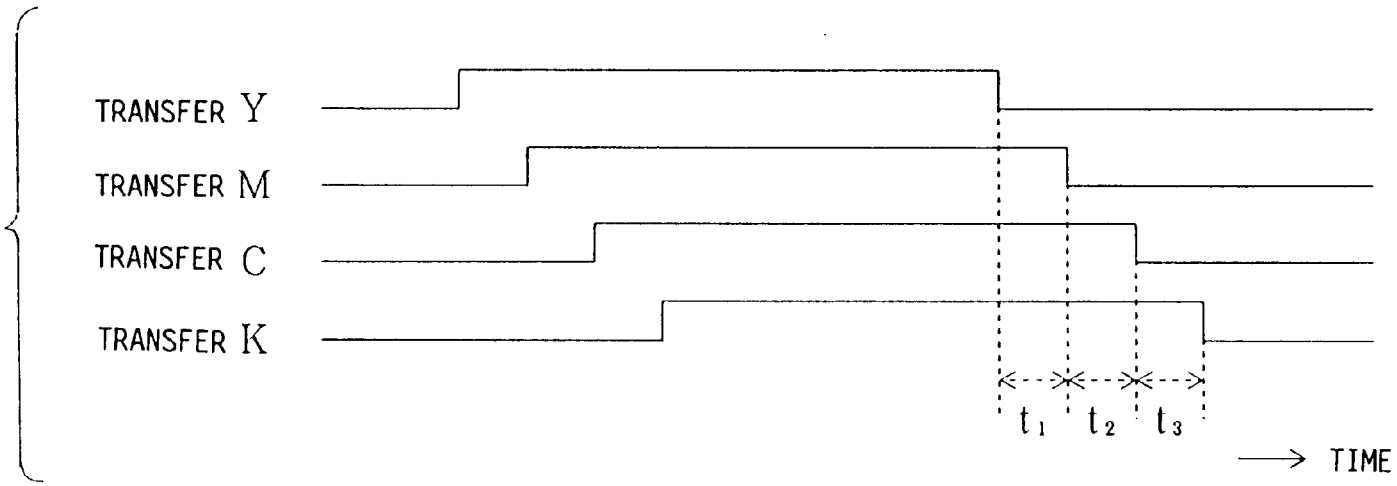
FIG. 19 is a time chart showing timings with which a transfer voltage is supplied with respect to each of image forming units.

In addition, if the image transfers with respect to the recording sheet 9 by the image forming units 2Y, 2M, 2C and 2K are respectively denoted by Y, M, C and K, it is desirable to control end times of the image transfers Y, M, C and K to satisfy $t1 \geqq 0$, $t2 \geqq 0$ and $t3 \geqq 0$ as shown in FIG. 19, so that the image transfer by an image forming unit located on the downstream side along the transport direction of the recording sheet 9 will not end before the image transfer by an image forming unit located on the upstream side. In FIG. 19, t1 denotes a time difference between the end times of the image transfers Y and M, t2 denotes a time difference between the end times of the image transfers M and C, and t2 denotes a time difference between the end times of the image transfers C and K.

Figure 20:
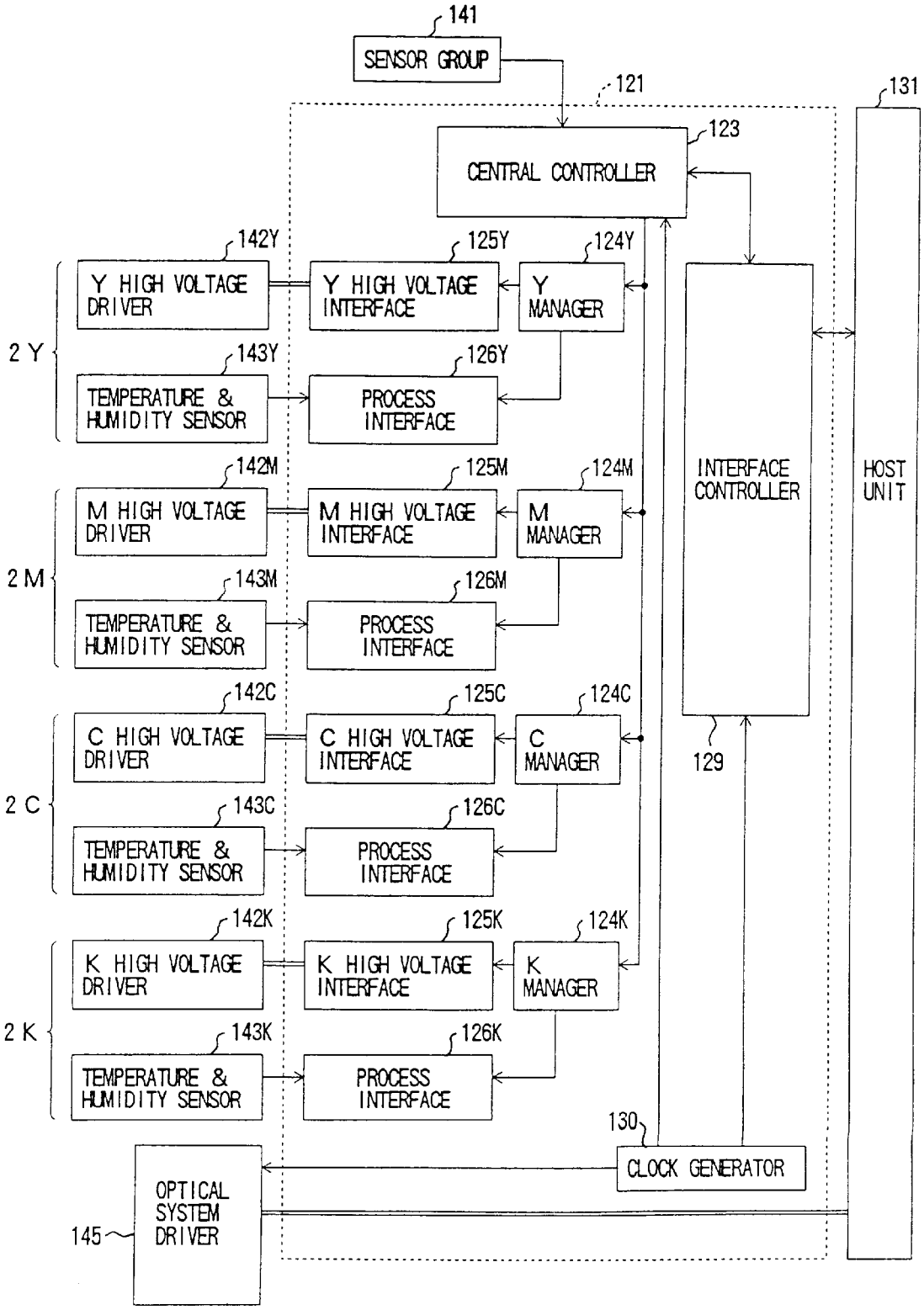
FIG. 20 is a system block diagram showing the construction of a part of the second embodiment of the image forming apparatus.

FIG. 20 is a system block diagram for explaining the operation of the second embodiment of the image forming apparatus in more detail. FIG. 20 only shows parts of the image forming apparatus directly related to the operation of this embodiment.

The image forming apparatus shown in FIG. 20 generally includes a printer part 121, a sensor group 141, the image forming units 2Y, 2M, 2C and 2K, and an optical system driver 145. The image forming unit 2Y includes a Y high voltage driver 142Y and a temperature and humidity sensor 143Y, the image forming unit 2M includes a M high voltage driver 142M and a temperature and humidity sensor 143M, the image forming unit 2C includes a C high voltage driver 142C and a temperature and humidity sensor 143Y, and the image forming unit 2K includes a K high voltage driver 142K and a temperature and humidity sensor 143K. The printer part 121 includes a central controller 123, Y, M, C and K managers 124Y, 124M, 124C and 124K, Y, M, C and K high voltage interfaces 125Y, 125M, 125C and 125K, Y, M, C and K process interfaces 126Y, 126M, 126C and 126K, an interface controller 129, and a clock generator 130. A host unit 131 may be a part of the image forming apparatus or, be a host to the image forming apparatus.

The central controller 123 includes a CPU or the like which controls the entire operation of the printer part 121 based on an instruction which is obtained from the host unit 311 via the interface controller 129, and a memory. Data required for the operation of the central controller 123 and intermediate data are stored in the memory of the central controller 123. The instruction from the host unit 131 includes information indicating which of the image forming units Y, M, C and K are to be used. Of course, it is possible to provide the data storage 28 shown in FIG. 4 and use the data storage 28 as the memory of the central controller 123. The Y manager 124Y receives the instruction from the central controller 123 and temperature and humidity information from the temperature and humidity sensor 143Y via the Y process interface 126Y, and based thereon, controls the Y high voltage driver 142Y via the Y high voltage interface 125Y so as to control the transfer voltage that is applied to the image forming unit 2Y. In addition, the M manager 124M receives the instruction from the central controller 123 and temperature and humidity information from the temperature and humidity sensor 143M via the M process interface 126M, and based thereon, controls the M high voltage driver 142M via the M high voltage interface 125M so as to control the transfer voltage that is applied to the image forming unit 2M. Similarly, the C manager 124C receives the instruction from the central controller 123 and temperature and humidity information from the temperature and humidity sensor 143C via the C process interface 126C, and based thereon, controls the C high voltage driver 142C via the C high voltage interface 125C so as to control the transfer voltage that is applied to the image forming unit 2C. Furthermore, the K manager 124K receives the instruction from the central controller 123 and temperature and humidity information from the temperature and humidity sensor 143K via the K process interface 126K, and based thereon, controls the K high voltage driver 142K via the K high voltage interface 125K so as to control the transfer voltage that is applied to the image forming unit 2K.

The Y manager 124Y can be realized by a CPU having a known construction and a memory which stores programs of this CPU and data including intermediate data. Similarly, each of the M, C and K managers 124M, 124C and 124K can be realized by such a CPU and a memory. Moreover, it is possible to realize two or more managers out of the Y, M, C and K managers 124Y, 124M, 124C and 124K by a single CPU and a memory. In addition, it is possible to realize the central controller 123 and the Y, M, C and K managers 124Y, 124M, 124C and 124K by a single CPU and a memory.

The clock generator 130 supplies clock signals to the central controller 123 and the interface controller 129 within the printer part 121 and the optical system driver 145, and controls operation timings thereof.

The sensor group 141 includes a plurality of sensors which detect information related to the environment of the image forming apparatus, other than the temperature and humidity, information related to the operation state of the image forming apparatus and the like, and the detected information is supplied to the central controller 123. Examples of the sensors which detect the information related to the operation state include a sensor which detects agitation of the developing agent in the developing unit 2*d,* and a sensor which detects the size of the recording sheet 9 used. Accordingly, the Y, M, C and K managers 124Y, 124M, 124C and 124K can carry out control based on the information which is related to the environment and the operation state and is obtained from the central controller 123.

The optical system driver 145 drives a known write system which carries out a laser write operation with respect to the photoconductive drum 2*a* of each of the image forming units 2Y, 2M, 2C and 2K, based on image data received from the host unit 131. This optical system driver 145 itself also has a known construction.

Figure 21:
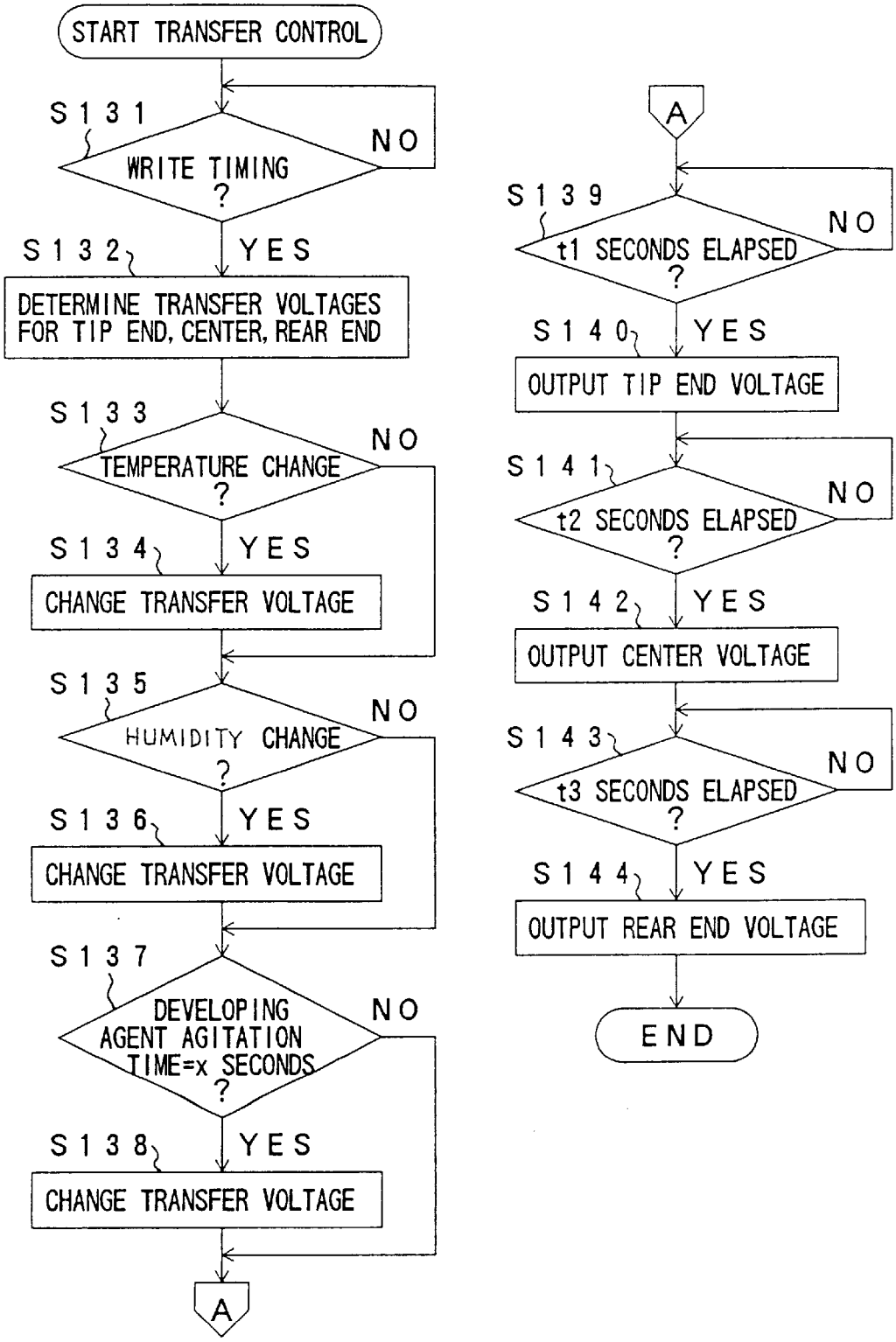
FIG. 21 is a flow chart for explaining an embodiment of the operation of the CPU.

FIG. 21 is a flow chart for explaining an embodiment of the operation of a single CPU when at least the Y, M, C and K managers 124Y, 124M, 124C and 124K are formed by the CPU in this second embodiment of the image forming apparatus. In FIG. 21, a step S131 decides whether or not it is the Y image write timing. When the decision result in the step S131 becomes YES, a step S132 determines the transfer voltages with respect to the tip end, the center and the rear end of the recording sheet 9 as described above in conjunction with FIG. 18. A step S133 decides whether or not a temperature change occurred, based on the detected temperature received from the temperature and humidity sensor 143Y. If the decision result in the step S133 is YES, a step S134 changes the transfer voltages with respect to the tip end, the center and the rear end of the recording sheet 9 depending on the detected temperature. If the decision result in the step S133 is NO or after the step S134, a step S135 decides whether or not a humidity change occurred, based on the detected humidity received from the temperature and humidity sensor 143Y. If the decision result in the step S135 is YES, a step S136 changes the transfer voltages with respect to the tip end, the center and the rear end of the recording sheet 9 depending on the detected humidity. If the decision result in the step S135 is NO or after the step S136, a step S137 monitors the developing agent agitation based on a detection signal from a sensor which is included in the sensor group 141 and detects the agitation of the developing agent within the developing unit 2*d,* and decides whether or not the developing agent agitation time has become x seconds. If the decision result in the step S137 is YES, a step S138 changes the transfer voltages with respect to the tip end, the center and the rear end of the recording sheet 9 depending on the developing agent agitation time which is x or more seconds. If the decision result in the step S137 is NO or after the step S138, the process advances to a step S139.

The above described steps S131 through 138 are similarly carried out with respect to M, C and K.

The developing agent agitation time may be monitored by an internal timer of the central controller 123 based on the detection signal from the sensor which detects the agitation of the developing agent, and the monitored result may be supplied to the Y manager 124Y. Alternatively, the detection signal from the sensor which detects the agitation of the developing agent may be supplied as it is to the Y manager 124Y, and the developing agent agitation time may be monitored by an internal timer of the Y manager 124Y.

The step S139 decides whether or not the time difference t1 shown in FIG. 19 has elapsed using an internal timer. When the decision result in the step S139 becomes YES, a step S140 outputs the transfer voltage with respect to the tip end of the recording sheet 9. A step S141 decides whether or not the time difference t2 shown in FIG. 19 has elapsed using the internal timer. When the decision result in the step S141 becomes YES, a step S142 outputs the transfer voltage with respect to the center of the recording sheet 9. Furthermore, a step S143 decides whether or not the time difference t3 shown in FIG. 19 has elapsed using the internal timer. When the decision result in the step S143 becomes YES, a step S144 outputs the transfer voltage with respect to the rear end of the recording sheet 9, and the process ends.

Therefore, according to this embodiment, it is possible to improve the image transfer efficiency by independently controlling the transfer voltages with respect to the plurality of image forming units.

Of course, the present invention is not limited to the application to the image forming apparatuses having the construction described above and the present invention is similarly applicable to image forming apparatuses such as printers and copying machines having constructions other than those of the above described embodiments. In addition, it is possible to appropriately combine the first and second embodiments described above.

Further, the present invention is not limited to these embodiments, but various variations and modifications may be made without departing from the scope of the present invention.

What is claimed is:

1. An image forming apparatus comprising:

a fixing unit having at least one fixing heat roller and a plurality of heat sources with respect to said one fixing heat roller; and control means for setting a target temperature with respect to each of the plurality of heat sources and independently controlling each of the heat sources using a plurality of incrementally variable driving duties per unit time to reach the target temperature.

2. The image forming apparatus as claimed in claim 1, which further comprises:

a detector detecting a temperature of said fixing unit and outputting a detected temperature of said fixing unit and outputting a detected temperature, said control means changing each of the driving duties per unit time based on the detected temperature output from said detector with respect to each of the heat sources.

3. The image forming apparatus as claimed in claim 1, wherein said control means shifts drive start timings with respect to each of the heat sources.

4. The image forming apparatus as claimed in claim 3, wherein said control means shifts drive end timings with respect to each of the heat sources.

5. The image forming apparatus as claimed in claim 1, wherein said control means shifts drive end timings with respect to each of the heat sources.

6. The image forming apparatus as claimed in claim 1, which further comprises:

a plurality of image forming units transferring images on a medium, said control means independently controlling transfer voltages with respect to each of said plurality of image forming units.

7. An image forming apparatus comprising:

a fixing unit having at least one fixing heat roller and a plurality of heat sources with respect to said one fixing heat roller; and control means for setting a target temperature with respect to each of the plurality of heat sources and independently controlling each of the heat sources, wherein said control means shifts drive end timings with respect to each of the heat sources, and wherein said control means includes compensation means for compensating for an insufficient amount of thermal energy generated by the heat sources which are driven by driving a heat source which is originally not driven.

8. An image forming apparatus comprising:

a fixing unit having at least one fixing heat roller and a plurality of heat sources with respect to said one fixing heat roller; and control means for setting a target temperature with respect to each of the plurality of heat sources and independently controlling each of the heat sources, wherein said control means shifts drive start timings with respect to each of the heat sources, and wherein said control means includes compensation means for compensating for an insufficient amount of thermal energy generated by the heat sources which are driven by driving a heat source which is originally not driven.

9. An image forming apparatus comprising:

a fixing unit having at least one fixing heat roller and a plurality of heat sources with respect to said one fixing heat roller; and control means for setting a target temperature with respect to each of the plurality of heat sources and independently controlling each of the heat sources, wherein said control means shifts drive start timings with respect to each of the heat sources, and wherein said control means includes compensation means for compensating for an insufficient amount of thermal energy generated by the heat sources which are driven at shifted timings, with respect to each of the heat sources.

10. An image forming apparatus comprising:

a fixing unit having at least one fixing heat roller and a plurality of heat sources with respect to said one fixing heat roller; and control means for setting a target temperature with respect to each of the plurality of heat sources and independently controlling each of the heat sources, wherein said control means shifts drive end timings with respect to each of the heat sources, and wherein said control means includes compensation means for compensating for an insufficient amount of thermal energy generated by the heat sources which are driven at shifted timings, with respect to each of the heat sources.

11. An image forming apparatus comprising:

a fixing unit having at least one fixing heat roller and a plurality of heat sources with respect to said one fixing heat roller; and control means for setting a target temperature with respect to each of the plurality of heat sources and independently controlling each of the heat sources, wherein said control means includes changing means for changing each of the heat sources which are driven at the shifted timings by other heat sources so as to average serviceable lives of each of the heat sources.

12. An image forming apparatus comprising:

a plurality of image forming units transferring images on a medium; and control means for independently controlling transfer voltages with respect to each of said plurality of image forming units, wherein said control means independently controls timings with which the transfer voltages are applied to each of said image forming units, and wherein said control means controls timings with which the transfer voltages are applied to each of said image forming units so as to maintain relative applying timing relationships of the transfer voltages with respect to said image forming units.

13. The image forming apparatus as claimed in claim 12, wherein said control means changes the transfer voltages with respect to each of said image forming units depending on a number of image forming units which are driven.

14. The image forming apparatus as claimed in claim 12, wherein said control means changes the transfer voltages with respect to each of said image forming units depending on an environment of said image forming units.

15. The image forming apparatus as claimed in claim 14, wherein said control means controls each of the transfer voltages so as to maintain relative magnitude relationships of the transfer voltages with respect to said image forming units.

16. An image forming apparatus comprising:

a fixing unit having at least one fixing heat roller and a plurality of heat sources with respect to said one fixing heat roller; and control means for independently controlling each of the plurality of heat sources to achieve a uniform traget temperature for the fixing unit.

* * * * *